US009226867B2

(12) United States Patent
Threlfall

(10) Patent No.: US 9,226,867 B2
(45) Date of Patent: Jan. 5, 2016

(54) EXTERNAL STRUCTURAL BRACE APPARATUS

(71) Applicant: John Threlfall, Volcano, HI (US)

(72) Inventor: John Threlfall, Volcano, HI (US)

( * ) Notice: Subject to any disclaimer, the term of this patent is extended or adjusted under 35 U.S.C. 154(b) by 189 days.

(21) Appl. No.: 13/938,188

(22) Filed: Jul. 9, 2013

(65) Prior Publication Data

US 2015/0018737 A1 Jan. 15, 2015

(51) Int. Cl.
*A61H 3/02* (2006.01)

(52) U.S. Cl.
CPC ..... *A61H 3/02* (2013.01); *A61H 3/0277* (2013.01); *A61H 2003/025* (2013.01); *A61H 2201/1261* (2013.01); *A61H 2201/1481* (2013.01); *A61H 2201/165* (2013.01); *A61H 2201/1614* (2013.01); *A61H 2201/1621* (2013.01); *A61H 2201/1635* (2013.01); *A61H 2201/1642* (2013.01)

(58) Field of Classification Search
CPC ..... A61H 3/00; A61H 2003/007; A61H 3/02; A61H 2003/0216; A61H 3/0277; A61H 3/008; A61H 1/0262; A61H 2003/005; A61G 13/12; A63B 23/04; A63B 23/0464; A63B 23/10; B25J 9/0006; A61F 5/0102
USPC ..... 128/845, 882, 892; 602/20, 23; 135/65, 135/68; 601/5, 23, 33, 34, 35; 482/66, 67, 482/69
See application file for complete search history.

(56) References Cited

U.S. PATENT DOCUMENTS 654,173 A 7/1900 Mendenhall
1,202,851 A 10/1916 Kelly
1,409,326 A 3/1922 Williamson
1,544,162 A 6/1925 Vigne
2,734,554 A * 2/1956 Ries ..... A61H 3/00 135/67
2,888,022 A * 5/1959 Fanning ..... A61H 3/0277 135/82
3,570,011 A 3/1971 Naig
4,253,479 A * 3/1981 Laurent ..... A45B 3/00 135/69
4,557,257 A 12/1985 Fernandez et al.
4,829,989 A 5/1989 Deamer
5,020,790 A 6/1991 Beard et al.
5,165,436 A 11/1992 Hall, Sr. et al.
5,282,460 A 2/1994 Boldt
5,458,145 A 10/1995 Davis
5,476,441 A 12/1995 Durfee et al.
5,640,986 A 6/1997 Herman
5,673,719 A 10/1997 Shofner
5,755,644 A 5/1998 Breems
5,961,476 A 10/1999 Betto et al.
5,961,541 A 10/1999 Ferrati
6,190,342 B1 2/2001 Taylor
(Continued)

*Primary Examiner* — Alireza Nia
*Assistant Examiner* — Michelle J Lee
(74) *Attorney, Agent, or Firm* — Roger A. Jackson

(57) ABSTRACT

An external structural brace apparatus and method for supporting a user on a surface and for the user to ambulate along the surface to relieve shoulder, armpit, hand, foot, and wrist loads, the apparatus includes first and second support beams that each have a telescoping cantilever beam that contacts the surface. The first and second support beams have a primary pivotal couple at one end to one another with a mechanism to create opposite symmetrical movement of the beams. An attachment element supports the user at their torso has a secondary pivotal connection to the first and second beams and third and fourth user handles that are pivotally attached to the first and second beams are for grasping by the user to extend and retract the telescoping cantilever beams to and from the surface at reduced and increased extension and retraction rates for user ease of ambulating along the surface.

2 Claims, 16 Drawing Sheets

(56) References Cited

U.S. PATENT DOCUMENTS

| | | | |
|---|---|---|---|
| 6,450,131 | B1 | 9/2002 | Broman |
| 7,429,253 | B2 | 9/2008 | Shimada et al. |
| 7,553,266 | B2 | 6/2009 | Abdoli |
| 7,628,766 | B1 | 12/2009 | Kazerooni et al. |
| 8,801,641 | B2 | 8/2014 | Kazerooni et al. |
| 2002/0082711 | A1 | 6/2002 | Kuhn et al. |
| 2006/0260620 | A1 | 11/2006 | Kazerooni et al. |
| 2007/0056592 | A1 | 3/2007 | Angold et al. |
| 2008/0154165 | A1 | 6/2008 | Ashihara et al. |
| 2009/0036815 | A1 | 2/2009 | Ido |
| 2009/0292369 | A1 | 11/2009 | Kazerooni et al. |
| 2010/0004577 | A1 | 1/2010 | Yasuhara et al. |
| 2010/0036302 | A1 | 2/2010 | Shimada et al. |
| 2010/0076360 | A1 | 3/2010 | Shimada et al. |
| 2010/0094185 | A1 | 4/2010 | Amundson et al. |
| 2012/0259259 | A1 | 10/2012 | Chugunov |
| 2014/0196757 | A1 * | 7/2014 | Goffer ..... A61H 3/02 135/66 |

* cited by examiner

EXTERNAL STRUCTURAL BRACE APPARATUS

RELATED APPLICATIONS

There are no related applications claiming priority.

TECHNICAL FIELD OF INVENTION

The present invention generally relates to a portable external structural exoskeleton apparatus utilized typically by an article for bracing and strengthening of the article. More particularly, the present invention helps maintain the structural relationship and integrity between the upper, middle, or lower body structures, in addition to restricting over extension of these body structures in an effort to minimize stress and potential injury to the individual's torso and limbs. Further, more particularly, the present invention provides an active, portable, and lightweight exoskeleton support apparatus that can be worn for long periods of time to assist an individual in performing repetitive high load movements involving stress to the structural portion of an individual's torso and limbs for activities that can include bending, lifting, and standing for extended periods of time.

BACKGROUND OF THE INVENTION

The medical profession may recommend the use of an individual with a back injury or potential back problem to use an exoskeleton structural support apparatus to alleviate the strain and provide relief to the back. The apparatus can immobilize and support the spine when there is a condition that needs to be treated. Depending on the apparatus used, it can put the spine in a neutral, upright, hyper-extended, flexed, or lateral-flexed position. An exoskeleton structural support apparatus can be used to control pain, lessen the chance of further injury, allow healing to take place, compensate for muscle weakness, or prevent or correct a deformity. They offer a safe, relatively inexpensive, non-invasive way to prevent future problems or to help an individual heal from a current condition. The use of exoskeleton structural support apparatus which are commonly termed "braces" is widely accepted and is an effective tool in the treatment of back disorders. In fact, more than 99% of orthopedic physicians advocate using braces as there is a high potential benefit and little downside risk of the individual wearing the brace. In fact, historically braces have been used as far back as 2000 B.C. Recently, braces have become a popular way to help prevent primary and secondary lower back pain from ever occurring or reoccurring.

The Occupational Safety & Health Administration (OSHA) cites injuries to the upper, middle, and lower back as the most common reason for absenteeism in the general workforce after the common cold. It is estimated that about 80% of adults in North America can expect a back injury in their lifetime and about 10% can expect a re-injury. Back injuries can develop gradually as a result of micro-trauma brought about by repetitive activity over a period time or a single traumatic event. Back injuries can be the immediate result of improper lifting techniques and/or lifting loads that are too heavy for the back to support or brought on by repetitive lifting of lighter loads.

While an acute injury may seem to be caused by a single well-defined incident, OSHA states that the actual cause can be from a series of micro traumas coupled by years of weakening of the muscular-skeletal support system by repetitive lifting and bending, being the most hidden type of injury.

Injuries can arise in muscles, ligaments, vertebras, and discs, either singly or in combination. Although back injuries do not cause death, they do account for a significant loss in productivity, income, and expenses plus the physical suffering. For some, the pain and suffering is long-term or even lifelong. For individuals with long-term, disabling musculoskeletal injuries, lifetime earnings may drop significantly. These individuals may also suffer a loss of independence due to a restricted ability to ambulate or complete daily tasks such as cooking, cleaning, bathing, dressing, and the like that can lead to a diminished quality of life and depression.

OSHA cites back injuries in the United States as one of the leading causes of workplace absenteeism and disability; it afflicts over 600,000 employees each year with a cost of about $50 billion in lost productivity and medical costs. In addition, one to five percent of this group will suffer chronic back pain that lasts six months or longer. The frequency and economic impact of back injuries on the work force are expected to increase significantly over the next several decades as the age of the working population increases and the cost of healthcare escalates, thus intensifying the problem. For those under the age of 45, back pain is the most frequent cause of activity limitation. Although 80% to 90% of individuals will recover from back pain within three to six days of their injury, the Journal of the American Medical Association estimates that $31 million will be spent on physician office visits and $20 billion on prescription drugs—and only three percent of that total cost will go to prevention of back pain.

Thus, it is clear that there is a great need in the art for an improved method and system for providing active support to the upper, middle, and lower back to assist in bending, lifting, and standing to prevent injury while avoiding the shortcomings and drawbacks of the prior art apparatuses and methodologies as reviewed in the following section.

PRIOR ART

In looking at the high end of the prior art in this area with powered exoskeletons, Lockheed Martin has designed a Human Universal Load Carrier termed an acronym as the HULC being an anthropomorphic exoskeleton robot for soldiers carrying heavy combat loads that increase the stress on the body leading to potential injuries. With the Lockheed Martin wearable exoskeleton robot, these loads are transferred to the ground through powered titanium legs without loss of mobility. The Lockheed Martin HULC is a completely un-tethered, hydraulic-powered anthropomorphic exoskeleton that provides individuals with the ability to carry loads of up to 200 lbs for extended periods of time and over all terrains. The flexible design of the Lockheed Martin allows for deep squats, crawls and upper-body lifting. The Lockheed Martin exoskeleton fits individuals from 5'4" to 6'2" and weighs approximately 53 pounds. The Lockheed Martin exoskeleton senses what users want to do and where they want to go in addition to augmenting their ability, strength and endurance. An onboard micro-computer ensures the Lockheed Martin exoskeleton moves in concert with the individual. The Lockheed Martin modularity allows for major components to be swapped out in the field, in addition to having a unique power-saving design for the user to operate on battery power for extended missions.

Also in this same area Berkley Bionics has designed an eLEGS exoskeleton that has an emphasis on helping paraplegics walk, having the same root design team that developed the HULC as previously described, having a lot of the same design methodology in using battery powered hydraulics. However, both the HULC and the eLEGS are both currently in the developmental prototyping stage having a cost of about $100,000 per unit, with a likely potential of a price reduction to $50,000 for a simplified version, thus still being an esoteric technology for now.

Now looking considerably back in time at the prior art, toward simpler non-powered exoskeleton apparatus that utilize springs, wire, and elastomeric components as assistive exoskeletons, starting with U.S. Pat. No. 654,173 to Mendenhall discloses a back-brace for cotton pickers or any activity requiring a repetitive stooping posture. In Mendenhall the apparatus is attached to the individual's shoulders, waist, and limbs, and uses wire interconnected between flexible elastic fabric straps which press against the individual's lower portion of their back, being connected to the user's shoulders and upper legs, exerting a resistive support for the lower back, see FIG. 1, items 1, 3, 5, and 14, particularly when the user is bending or stooping over. Two major problems with Mendenhall are that it requires additional effort from the user to do the initial bending or stooping over as the wires 16 will limit the amount of bending over that can be done, and further to this the wire 16 with the attachment point on the user's shoulders and upper legs acts to put the user's back into added compression, thus the exoskeleton in Mendenhall does not itself carry any of the user's load, it simply transfers the load to the added compressive force upon the user's back, which is undesirable.

Similar to Mendenhall, in Vigne being in U.S. Pat. No. 1,544,162 discloses a set of more than 15 adjustable straps that attach to the shoulders, waist, hips, and knees of the user, wherein these attachment straps are interconnected with coiled springs 13, 17, and 8, as shown in FIGS. 1 and 2, that urge the straps toward one another, thus again as in Mendenhall when the user bends over there is resistance and then in an opposing manner then coiled spring urges the user into an erect standing position. However, much the same as Mendenhall, the coiled springs put compressive stress upon the back of the user which is undesirable and the exoskeleton carries absolutely no weight or load itself, as the flexible straps and coiled springs apparatus of Vigne has no independent stiffness of its own and thus does not remove any load from the user's bone structure and even worse both Mendenhall and Vigne further increase the compressive force loading on the user's back, thus in effect leaving the user worse off than if they did not use the Mendenhall or Vigne apparatus at all.

Also somewhat like Mendenhall and Vigne, however, a bit of improvement due to the coil spring providing lateral bending resistance with tensile resistance, in U.S. Pat. No. 1,202,851 to Kelly disclosed a back brace with an elongated bar twisted between its ends into a coil spring with an adjustable mounted pad designed to rest against the lower back thereby connecting at its opposing ends to the shoulder and the upper legs of the user, see FIG. 1. In Kelly each end of the rod has padded grips and is connected to the rod by adjustable couplings. One Y-shaped padded bar in Kelly extends over the shoulders while a second y-shaped bar is used to attach the upper thighs to the support apparatus. Kelly attaches to the upper body and thighs using no fasteners and is used to lightly and support an individual bending at the hips. In addition, Kelly does not offer a means to adjust the amount of support offered by the apparatus. Thus as differentiated as against Mendenhall and Vigne, Kelly does not solely rely upon a wire or coiled spring to urge the user into an erect position via only tensile pulling along a longitudinal axis of the wire or coiled spring, with Kelly at least recognizing the problem of needing lateral stiffness (being perpendicular to the wire or coiled spring longitudinal axis) as being required for the exoskeleton to actually carry some of the user's load. However, Kelly still has a component of longitudinally based tensile contracting force due to the coil spring, and thus can still put the user's back in undesirable compression, thus having the same drawbacks as Mendenhall and Vigne in that area as previously described.

Finally in getting away from the wire or coiled spring that exerts pulling tension along its longitudinal axis, Williamson uses a multi plate leaf type spring 2, as disclosed in U.S. Pat. No. 1,409,326 wherein the leaf spring 2, as shown in FIGS. 1 and 2, does not induce longitudinally based pulling tension on its own, which is highly desirable as not independently inducing a compressive loading upon the back. Functionally overall Williamson is much like Mendenhall, Vigne, and Kelly and includes a spring lift apparatus which when worn by an individual will assist individual in repeated bending over and stooping to relieve lower back strain. Further, the Williamson apparatus assists an individual in raising the upper body to an erect position while allowing the individual to temporarily sit while wearing the apparatus. The Williamson apparatus is strapped to the individuals head, upper chest, and knee for support, see FIG. 2 items 5, 6, 17 and 18 and FIG. 1 items 10, 12, 13, and 14. In addition, Williamson is strapped to the individual's head, shoulders, one leg, and shovel, also including a fixed setting for support and resistance, see FIG. 2 17, 18 and FIG. 1 items 10, 12, 13, and 14. The Williamson apparatus provides unbalanced asymmetrical support to the back by strapping itself to only one leg of an individual, as the asymmetrical attachment to the individual creates unequal support for the left and right lower back. A further problem in Williamson is in the racket 10 and setscrew 11 as shown in FIG. 2, wherein with the user stooped over there is a locked longitudinal arrangement as between the bracket 10 and the rigid extension 4 that in effect will produce the undesirable effect of again compressing the back of the user as when the bend or stoop over extension 4 will pull downward compressing the back, thus again bringing on the same problems as previously described in Mendenhall, Vigne, and Kelly in that area as previously described, thus due to the bracket 10 and the setscrew 11 completely takes away the benefit of the leaf spring 2 as also previously described.

Finally, the next reference to Naig in U.S. Pat. No. 3,570,011 does a better job of not compressing the user's back by using a beam 12 that pivots upon the user's lower back to simply pull against the user's upper chest in a manner completely perpendicular to the user's back, however, adding the somewhat undesirable issue of putting the user's lower back and legs into compression, which probably being better than putting the user's back into compression via elastic straps 52, whereas straps 44 are not stretchable, thus even this compression is still not desirable, further Naig is quite large and bulky, especially due to tubular frame 12, see in particular FIG. 2. In detail, Naig is comprised of a series of ropes, straps, buckles and harnesses used to attach the apparatus to individual's chest, waist, hips, ankles and feet, see FIG. 1 items 10, 12, 14, 16, 20, 26, 30, 34, 36, 44 and 57.

In an opposite approach, Deamer in U.S. Pat. No. 4,829,989 is mounted on the user's front or chest side as opposed to all the previously described references that have the exoskeleton apparatus mount on the back side of the user, thus again recognizing the problem of avoiding compressive force upon the user back, that was somewhat recognized by Naig, Williamson, and Kelly. Thus Deamer is pushing with force against the user's chest and the front of the user's legs wherein slidable pads 32 and 36 help preclude compressive force to be placed upon the user's back, which the Deamer apparatus urges the user into an upright position. Deamer is a portable spring leveraged apparatus that attaches to the individual's hips to offset the strain to the hips while stooping. The Deamer apparatus includes a U-shaped frame, hinged in each arm of the U and provided with spring urging at each hinge point, see FIG. 2 items 32 and 40. The Deamer frame is belt mounted at the individual's waist with the hinge points adjacent the hips and with the bottom of the U and arms providing padded slidable contact at the individual's chest and thighs, respectively, see FIG. 1, items 22, 28, 32, 36, 34, and 40. In Deamer the two arms 46 provide independent leg movement for walking while the chest contact 32 resiliently supports the upper torso weight during leaning and stooping. The Deamer apparatus only provides one way support and restraint to the lower back when an individual bends forward and does not provide support for bending backward.

Further, having much the same design and drawbacks as Vigne, in U.S. Pat. No. 6,190,342 to Taylor, disclosed a back harness for the alleviation of individual's back strain using multiple elastic straps than run longitudinally along the user's legs and back, see FIG. 2A and FIG. 2B, wherein undesirably again the user's back is put into compression from the elastics 19, 21, and 45. The Taylor harness provides urging from the shoulders to the lower back and legs if the user into the upright position and provides light assistance in lifting medium weight objects, however, as in Vigne, Taylor provide absolutely no rigidity on its own. Taylor provides the upright urging from the shoulders to the lower back using soft elastic straps 19, 21, and 45. Taylor requires the individual to install and wear a cumbersome number of straps buckled to the torso, shoulders, upper back, mid torso, upper legs, mid-legs, ankles and feet.

Continuing in this area in the prior art in the U.S. Pat. No. 6,450,131 to Broman which is similar to Mendenhall discloses a light flimsy harness for supposedly preventing lower back injuries caused by improper bending and lifting however, again as in Mendenhall, the user's back is put undesirably into compression from the user bending over or stooping and also as in Mendenhall the Broman apparatus has no independent stiffness with which to support any weight or load. In Broman the harness consists of a thin, light weight flexible back strap 26 and two flexible shoulder straps 28 as shown in FIG. 2. The Broman harness and straps are used to allow forward bending of the lower back and an individual's knees. In Broman two additional straps 38 compose the lower portion of this apparatus that are connected to the back 26 and shoulder 28 straps, with the lower left strap has one end connected to the left foot, while the lower right strap has one end connected to the right foot, see FIG. 2.

Yet further in the prior art in the U.S. Pat. No. 7,553,266 to Abdoli, being fairly like Naig discloses a lift assist apparatus and method, however, being worse than Naig in that the user's back is put into undesirable compression via elastic member 40, 50, 60 and 70 as shown in FIG. 1, as opposed to Naig who used a rigid member 12 to pivot upon the user's lower back thus inducing a force perpendicular to the user's back, wherein Abdoli pulls the user's shoulders toward the lower back in order to urge the user in an upright position, thus putting the user's back into the undesirable compression, and further also undesirably putting the user's legs into compression. Abdoli includes two anchors that attach to the sides of the individual's body joints and elastic straps connecting the first anchor and the second anchor to the individual's torso, see FIG. 1 items 5, 20, 25, 30 and 35. The Abdoli apparatus may be used at an individual's waist, ankle, wrist, knee, hip, elbow, shoulder, and/or at least one joint of the back and/or neck. In Abdoli, articulation of the individual's joint in a first direction causes deformation of the elastic member and storing of energy, and articulation of the joint in a second direction causes relaxation of the elastic member wherein the energy is released and assists the individual to perform a motion in said second direction. The Abdoli system uses soft fabric and elastic straps to passively support an individual's back. The passive support is adjustable by loosening and tightening the fabric straps, noting that as previously discussed in Mendenhall, Vigne, Taylor, and Broman, Abdoli has no independent rigidity to remove any load from the user.

Moving to very narrow and specific purpose exoskeleton apparatus in the prior art in U.S. Pat. No. 4,638,510 to Hubbard, disclosed is a head and neck restraint apparatus for use in a high performance vehicle, see FIG. 1 and in particular straps 15 a, 15b, and 15c, further in FIG. 3. The primary function of Hubbard is to protect the head and neck positional relationship upon impact, thereby helping to prevent hyper extending neck injury upon a frontal impact. The Hubbard apparatus includes a tether strap attached between the vehicle and the helmet, wherein the tether provides the individual's restraint. The Hubbard apparatus is used in conjunction with a harness seat assembly that affixes the individual's head and neck to the vehicles seat via the helmet to help restrict movement. The Hubbard apparatus is very specific in only protecting the head and neck positional relationship and makes no attempt to protect the upper, middle or lower back when bending, lifting, standing and pushing.

In looking at specifically the use of stiffening flex rods as they are currently applied to exercise machines in the prior art, in U.S. Pat. No. 4,620,704 to Shefferaw, relating to an exercising machine having a plurality of different cross sectional diameter resilient rods which are flexed laterally (i.e. perpendicular to their longitudinal axis) and resist movement of an individual using the exercise machine via cables, see FIG. 12 and FIG. 13, items 44 and 52. In Shefferaw '704 forces are exerted on the resilient rods through cables to which a variety of attachments such as hand grips, foot stirrups, and a sliding bench can be connected to exercise different parts of the body. The rods in Shefferaw '704 can be used in any combination to suit the requirements and physical abilities of the person using the machine. Shefferaw '704 contains the plurality of vertically extending rods of resilient material mounted on a post in a cantilevered fashion with the lower ends of the rods being rigidly affixed to the post and the upper ends of the rods being cantilevered freely and selectively connectable to the various cables to the previously mentioned attachments. The Shefferaw '704 apparatus requires the use of distinctive different cross section diameter rods to vary the degree of lateral flexing resistance. The Shefferaw '704 apparatus was designed to stay in a permanent, fixed position and not designed to be carried in a portable manner by an individual. In a second patent to Shefferaw, in U.S. Pat. No. 4,725,057, Shefferaw adds the ability for an individual to collapse the exercising machine for storage and portability to Shefferaw U.S. Pat. No. 4,620,704.

What is needed is an external structural brace apparatus that is practical, affordable, and portable, requires no power to operate, is easy to take on and off, is easily adjustable for varying stiffness and that has the ability to provide rigid user skeletal support without placing compressive loading upon the user's own skeletal structure.

SUMMARY OF THE INVENTION

Broadly an external structural brace apparatus for supporting a user on a surface and for the user to ambulate along the surface to relieve shoulder, armpit, hand, foot, and wrist loads, the external structural brace apparatus including a first support extension beam having a first proximal end portion and an opposing first distal end portion and a first longitudinal axis spanning therebetween, the first distal end portion including a first telescoping cantilever beam having extension and retraction movement along the first longitudinal axis to vary a total length of the first support extension beam, wherein the first telescoping cantilever beam has intermittent contact with the surface. Further included in the external structural brace apparatus is a second support extension beam having a second proximal end portion and an opposing second distal end portion and a second longitudinal axis spanning therebetween, the second distal end portion including a second telescoping cantilever beam having extension and retraction movement along the second longitudinal axis to vary a total length of the second support extension beam, wherein the second telescoping cantilever beam has intermittent contact with the surface. In addition, the first and second proximal end portions have a primary pivotal couple to one another, wherein the first and second support extension beams are limited to have a primary pivotal movement relative to one another in a single primary radial plane.

Also included is a mechanism affixed therebetween the first and second proximal end portions that causes the primary pivotal movement to be symmetrical as between the first and second distal end portions in equal and opposite directions, wherein a single primary pivotal movement initiated at the first distal end portion causes an automatic equal and opposite primary pivotal movement of the second distal end portion and a single primary pivotal movement initiated at the second distal end portion causes an automatic equal and opposite primary pivotal movement of the first distal end portion;

Further included is an attachment element structure that has a secondary pivotal connection to the first and second proximal end portions, allowing a secondary pivotal movement that is limited to a single secondary pivotal movement plane that is oriented in a perpendicular manner to the primary radial plane, wherein the attachment element structure is sized and configured to removably engage an upper torso portion of the user. Additionally included is a third handle structure that has a first pivotal engagement on the first proximal end portion, wherein the first pivotal engagement has movement along the first longitudinal axis and a fourth handle structure that has a second pivotal engagement on the second proximal end portion, wherein the second pivotal engagement has movement along the second longitudinal axis.

Continuing, the external structural brace apparatus includes a third means for facilitating same direction movement of the third handle structure and the first telescoping cantilever beam, wherein there is a decreasing speed of relative movement of the first telescoping cantilever beam in relation to the third handle structure movement, as the third handle structure is manually pushed toward the first telescoping cantilever beam, to accommodate the user being able to more precisely position the first telescoping cantilever beam on the surface as the user's arm is extended toward the first telescoping cantilever beam. Further the third means accommodates an increasing speed of retraction movement of the first telescoping cantilever beam as the third handle structure is manually pulled away from the first telescoping cantilever beam to help the first telescoping cantilever beam better clear obstacles on the surface for the user to ambulate along the surface.

Further, the external structural brace apparatus includes a fourth means for facilitating same direction movement of the fourth handle structure and the second telescoping cantilever beam, wherein there is a decreasing speed of relative movement of the second telescoping cantilever beam in relation to the fourth handle structure movement, as the fourth handle structure is manually pushed toward the second telescoping cantilever beam, to accommodate the user being able to more precisely position the second telescoping cantilever beam on the surface as the user's arm is extended toward the second telescoping cantilever beam. Further the third means accommodates an increasing speed of retraction movement of the second telescoping cantilever beam as the fourth handle structure is manually pulled away from the second telescoping cantilever beam to help the second telescoping cantilever beam better clear obstacles on the surface for the user to ambulate along the surface.

Wherein operationally on the external structural brace apparatus the user is engaged to the attachment element structure at the user's upper torso portion, further the user utilizes each one of their hands to manually grasp each one of the third and fourth handle structures wherein the user while standing with their hands manually moves the first and second support extensions that are connected via the mechanism in the primary pivotal movement to place the first and second telescoping cantilever beams in contact with the surface for user stability in the single primary radial plane. At this point the user is able to assume a seated position being supported on the surface by the first and second telescoping cantilever beams, further the user can ambulate across the surface via standing while simultaneously the user pushing on the third and fourth handle structures toward the first and second telescoping cantilever beams that pushes downward on the first and second telescoping cantilever beams as the user's arms are extended to raise the entire external structural brace apparatus, thus assisting the user to stand, at which point the user pulls upward on the third and fourth handle structures resulting in the first and second telescoping cantilever beams lifting from the surface with the user then momentarily balancing on their foot on the surface. Subsequently the user utilizing the primary and secondary pivotal movements to selectively reposition the first and second telescoping cantilever beams on the surface with the user then pushing downward on the third and fourth handle structures to have the first and second telescoping cantilever beams contact the surface with the user then repositioning their foot on the surface for balance.

REFERENCE NUMBERS IN DRAWINGS

Figure 1:
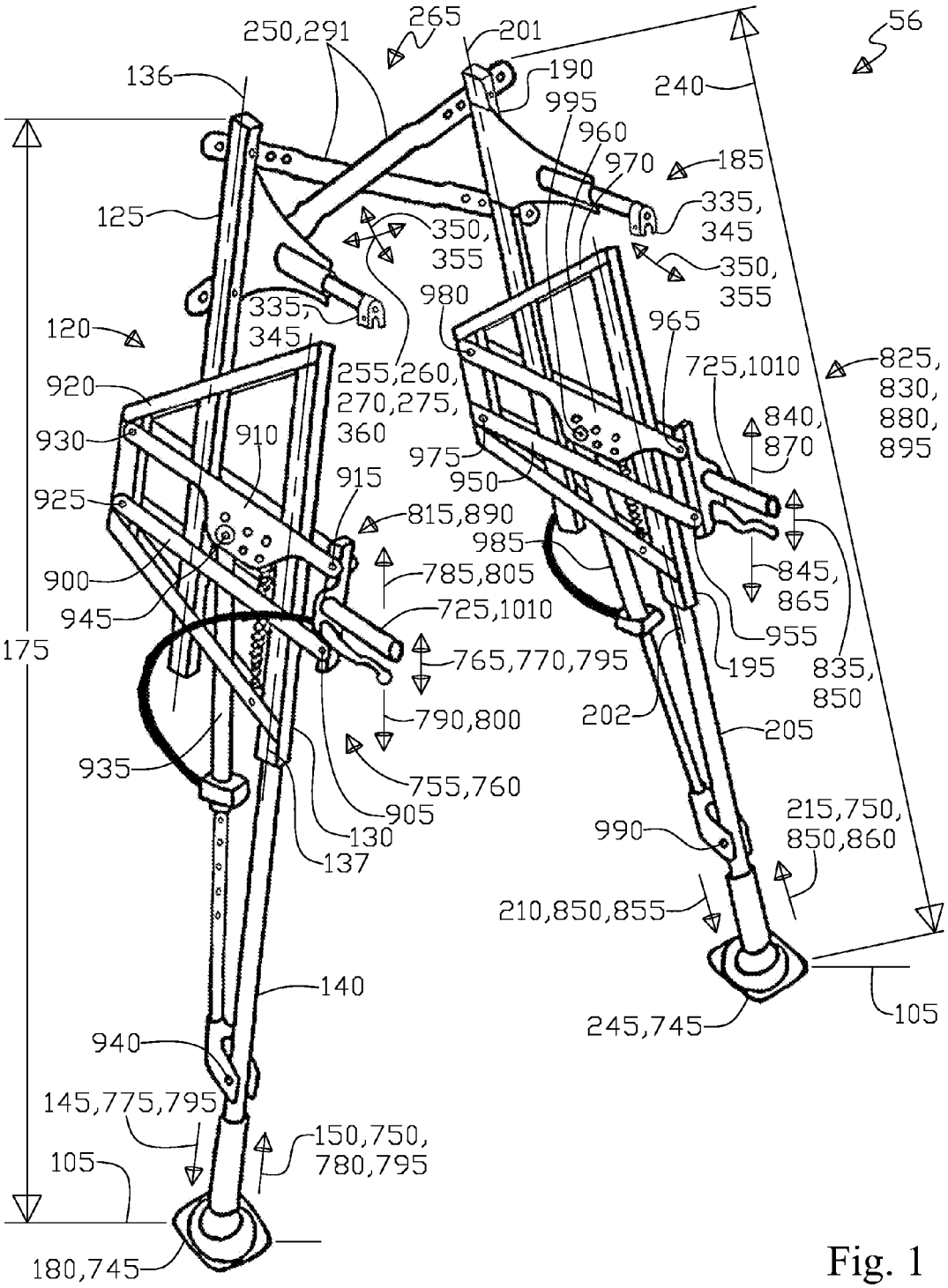
FIG. 1 shows a perspective view of a substitute structural brace apparatus.

50 External structural brace apparatus
55 Alternative embodiment of the structural brace apparatus
56 Substitute embodiment of the structural brace apparatus
60 User
65 Upper torso portion of user 60
70 Hip portion of user 60
75 Shoulder of user 60
80 Armpit of user 60
85 Arm of user 60
90 Hand of user 60
95 Foot of user 60
100 Wrist of user 60
105 Surface
110 Obstacle on the surface 105
115 Ambulate along surface 105 by user 60
120 First support extension beam
125 First proximal end portion of beam 120
130 First distal end portion of beam 120
135 First longitudinal axis of first support extension beam 120
136 First longitudinal axis of first support extension beam 120 proximal portion 125
137 First longitudinal axis of first support extension beam 120 distal portion 130
140 First telescoping cantilever beam
145 Extension movement of first cantilever beam 140
150 Retraction movement of first cantilever beam 140
155 Extended state of first cantilever beam 140
160 Retracted state of first cantilever beam 140
165 First retraction connection of first cantilever beam 140
170 First extension connection of first cantilever beam 140
175 Total length of first support extension beam 120
180 Intermittent contact of first cantilever beam 140 on surface 105
185 Second support extension beam
190 Second proximal end portion of beam 185
195 Second distal end portion of beam 185
200 Second longitudinal axis of second support extension beam 185
201 Second longitudinal axis of second support extension beam 185 proximal portion 190
202 Second longitudinal axis of second support extension beam 185 distal portion 195
205 Second telescoping cantilever beam
210 Extension movement of second cantilever beam 205
215 Retraction movement of second cantilever beam 205
220 Extended state of second cantilever beam 205
225 Retracted state of second cantilever beam 205
230 Second retraction connection of second cantilever beam 205
235 Second extension connection of second cantilever beam 205

240 Total length of second support extension beam 185
245 Intermittent contact of second cantilever beam 295 on surface 105
250 Primary pivotal couple
255 Primary pivotal movement of the couple 250
260 Single primary radial plane of primary pivotal movement 255
265 Mechanism
270 Symmetric primary pivotal movement 255
275 Primary pivotal movement 255 in symmetrically equal and opposite directions
280 First finger extension of the mechanism 265
285 Second finger extension of the mechanism 265
290 Linkage of the mechanism 265
291 Substitute linkage of the mechanism 265
295 First toothed segment extension of the mechanism 265
300 Second toothed segment extension of the mechanism 265
305 Rotatable engagement of the first 295 and second 300 toothed segments via meshing teeth
310 First pulley of the mechanism 265
315 Second pulley of the mechanism 265
320 Flexible element of the mechanism 265
325 Cross over X pattern of the flexible element 320
330 Rotatable engagement of the first 310 and second 315 pulleys via the flexible element 320
335 Attachment element structure
340 Framework of the attachment element 335 structure to removably engage the hip portion 70 of the user 60
345 Secondary pivotal connection of the attachment element structure 335
350 Secondary pivotal movement of the attachment element structure 335
355 Single secondary pivotal movement plane of the secondary pivotal movement 350
360 Perpendicular orientation of single secondary pivotal movement plane 355 to primary radial plane 260
365 Sizing and configuring of attachment element structure 335 to removably engage the upper torso 65 of the user 60
370 Sizing and configuring of attachment element structure 335 to removably engage the hip portion 70 of the user
375 First handle structure
380 First slidable engagement of the first handle structure 375
385 First saddle of the first slidable engagement 380
390 Movement of first handle structure 375 along the first longitudinal axis 135
395 Retraction movement of the first handle structure 375
400 Extension movement of the first handle structure 375
405 Same direction movement of the first handle structure 375 and the first telescoping cantilever beam 140
410 Push down of the first handle structure 375
415 Pull up of the first handle structure 375
420 Retracted state of the first handle structure 375
425 Midpoint state of the first handle structure 375
430 Extended state of the first handle structure 375
435 Decreasing mechanical advantage as between the first telescoping cantilever beam 140 and the first handle structure 375 as the first handle structure 375 is pushed down 410 and moved from the retracted state 420 to the mid-point state 425 to the extended state 430
440 Increasing speed of retraction movement of the first telescoping cantilever beam 140 as the first handle structure 375 is pulled up 415 and moves from the extended state 430 to the mid-point state 425 to the retracted state 420
445 Retraction end of the first handle structure 375
450 Extension end of the first handle structure 375
455 Pulley of the first handle structure 375
460 First arm
465 Rotatable mounting of the first handle pulley 455 on the first arm 460
470 First flexible retraction component guide
475 First flexible extension component guide
480 Clearing of the obstacles 110 on the surface 105 by the first telescoping cantilever beam 140
485 Second handle structure
490 Second slidable engagement of the second handle structure 485
495 Second saddle of the second slidable engagement 490
500 Movement of second handle structure 485 along the second longitudinal axis 200
505 Same direction movement of the second handle structure 485 and the second telescoping cantilever beam 205
510 Retraction movement of the second handle structure 485
515 Extension movement of the second handle structure 485
520 Same direction movement of the second handle structure 485 and the second telescoping cantilever beam 205
525 Push down of the second handle structure 485
530 Pull up of the second handle structure 485
535 Retracted state of the second handle structure 485
540 Midpoint state of the second handle structure 485
545 Extended state of the second handle structure 485
550 Decreasing mechanical advantage as between the second telescoping cantilever beam 205 and the second handle structure 485 as the second handle structure 485 is pushed down 525 and moved from the retracted state 535 to the mid-point state 540 to the extended state 545
555 Increasing speed of retraction movement of the second telescoping cantilever beam 205 as the second handle structure 485 is pulled up 530 and moves from the extended state 545 to the mid-point state 540 to the retracted state 535
560 Retraction end of the second handle structure 485
565 Extension end of the second handle structure 485
570 Pulley of the second handle structure 485
575 Second arm
580 Rotatable mounting of the second handle pulley 570 on the second arm 575
585 Second flexible retraction component guide
590 Second flexible extension component guide
600 Clearing of the obstacles 110 on the surface 105 by the second telescoping cantilever beam 205
605 First means for facilitating same direction movement 405 of the first handle structure 375 and the first telescoping cantilever beam 140 by having decreasing mechanical advantage 550 as between the first telescoping cantilever beam 140 and the first handle structure 375 as the first handle structure 375 is pushed downward 410 being moved from the retracted state 420 to the mid-point state 425 to the extended state 430 and increasing speed of retraction movement 440 of the first telescoping cantilever beam 140 as the first handle structure 375 moves from the extended state 430 to the mid-point state 425 to the retracted state 420
610 First flexible component
615 First flexible retraction end of the first flexible component 610
620 First flexible extension end of the first flexible component 610
625 First flexible loop
630 Circumferential contact of the first flexible loop 625 on the first handle pulley 455
635 First handle rotational extension and retraction movement on the first handle pulley 455
640 First eccentric periphery retraction segment that is rotationally coupled to the first handle pulley 455

645 First eccentric periphery extension segment that is rotationally coupled to the first handle pulley 455
650 First flexible retraction component
655 First flexible extension component
660 Effective moment arm of either first 605 or second 665 means
665 Second means for facilitating same direction movement 505 of the second handle structure 485 and the second telescoping cantilever beam 205 by having decreasing mechanical advantage 550 as between the second telescoping cantilever beam 205 and the second handle structure 485 as the second handle structure 485 is pushed downward 525 being moved from the retracted state 535 to the mid-point state 540 to the extended state 545 and increasing speed of retraction movement 555 of the second telescoping cantilever beam 205 as the second handle structure 485 moves from the extended state 545 to the mid-point state 540 to the retracted state 535
670 Second flexible component
675 Second flexible retraction end of the second flexible component 670
680 Second flexible extension end of the second flexible component 670
685 Second flexible loop
690 Circumferential contact of the second flexible loop 685 on the second handle pulley 570
700 Second handle structure 485 rotational extension and retraction movement of the second handle pulley 570
705 Second eccentric periphery retraction segment that is rotationally coupled to the second handle pulley 570
710 Second eccentric periphery extension segment that is rotationally coupled to the second handle pulley 570
715 Second flexible retraction component
720 Second flexible extension component
725 Manually grasping of the first 375, second 485, third 755, or fourth 825 handle structures by the user 60 hand 90
730 User 60 standing
735 Manual movement of the first 120 and second 185 support extension beams in the primary pivotal movement 255
740 Manual movement of the first 120 and second 185 support extension beams in the secondary pivotal movement 350
745 Contact of the first 140 and second 205 telescoping cantilever beams with the surface 105
750 Lifting of the first 140 and second 205 telescoping cantilever beams from the surface 105
755 Third handle structure
760 First pivotal engagement of the third handle structure 755
765 Movement of the first pivotal engagement 760 along the longitudinal axis 135
770 Same direction movement of the third handle structure 755 and the first telescoping cantilever beam 140
775 Decreasing relative extension movement 145 of the first telescoping cantilever beam 140 in relation to the third handle structure 755 movement 765
780 Increasing speed of retraction movement 150 of the first telescoping cantilever beam 140 in relation to the third handle structure 755
785 Retraction movement of the third handle structure 755
790 Extension movement of the third handle structure 755
795 Same direction movement 770 of the third handle structure 755 and the first telescoping cantilever beam 140
800 Push down of the third handle structure 755
805 Pull up of the third handle structure 755
810 Retracted state of the third handle structure 755
815 Midpoint state of the third handle structure 755
820 Extended state of the third handle structure 755
825 Fourth handle structure
830 Second pivotal engagement of the fourth handle structure 825
835 Movement of the second pivotal engagement 830 along the longitudinal axis 200
840 Retraction movement of the fourth handle structure 825
845 Extension movement of the fourth handle structure 825
850 Same direction movement of the fourth handle structure 825 and the second telescoping cantilever beam 205
855 Decreasing relative extension movement 210 of the second telescoping cantilever beam 205 in relation to the fourth handle structure 825 movement 845
860 Increasing speed of retraction movement 215 of the second telescoping cantilever beam 205 in relation to the fourth handle structure 825
865 Push down of the fourth handle structure 825
870 Pull up of the fourth handle structure 825
875 Retracted state of the fourth handle structure 825
880 Midpoint state of the fourth handle structure 825
885 Extended state of the fourth handle structure 825
890 Third means for facilitating same direction movement 770 of the third handle structure 755 and the first telescoping cantilever beam 140, wherein there is a decreasing relative movement 855 of the first telescoping cantilever beam 140 in relation to the third handle structure 755 movement 765, as the third handle structure 755 is manually pushed 800 toward the first telescoping cantilever beam 140, to accommodate the user 60 being able to more precisely position the first telescoping cantilever beam 140 on the surface 105 as the user's 60 arm 85 is extended toward the first telescoping cantilever beam 140, further there is an increasing speed of retraction movement 780 of the first telescoping cantilever beam 140 as the third handle structure 755 is manually pulled away 805 from the first telescoping cantilever beam 140 to help the first telescoping cantilever beam 140 better clear obstacles 110 on the surface 105 for the user 60 to ambulate 115 along the surface 105
895 Fourth means for facilitating same direction movement 850 of the fourth handle structure 825 and the second telescoping cantilever beam 205, wherein there is a decreasing relative movement 855 of the second telescoping cantilever beam 205 in relation to the fourth handle structure 825 movement 865, as the fourth handle structure 825 is manually pushed toward 865 the second telescoping cantilever beam 205, to accommodate the user 60 being able to more precisely position the second telescoping cantilever beam 205 on the surface 105 as the user's 60 arm 85 is extended toward the second telescoping cantilever beam 205, further there is an increasing speed of retraction movement 860 of the second telescoping cantilever beam 205 as the fourth handle structure 825 is manually pulled away 870 from the second telescoping cantilever beam 205 to help the second telescoping cantilever beam 205 better clear obstacles 110 on the surface 105 for the user 60 to ambulate 115 along the surface 105
900 First idle pivotal member
905 First idle pivotal connection between the first idle pivotal member 900 and the third handle structure 755
910 First primary pivotal member
915 First primary pivotal connection between the first primary pivotal member 910 and the third handle structure 755
920 Third arm
925 Opposing first idle pivotal connection between the third arm 920 and the first idle pivotal member 900

930 Opposing first primary pivotal connection between the third arm 920 and the first primary pivotal member 910
935 First link
940 Pivotal connection between the first link 935 and the first telescoping cantilever beam 140
945 Pivotal link connection on the first primary pivotal member 910 that is positioned in-between the third handle structure 755 and the third arm 920
950 Second idle pivotal member
955 Second idle pivotal connection between the second idle pivotal member 950 and the fourth handle structure 825
960 Second primary pivotal member
965 Second primary pivotal connection between the second primary pivotal member 960 and the fourth handle structure 825
970 Fourth arm
975 Opposing second idle pivotal connection between the fourth arm 970 and the second idle pivotal member 950
980 Opposing second primary pivotal connection between the fourth arm 970 and the second primary pivotal member 960
985 Second link
990 Pivotal connection between the second link 985 and the second telescoping cantilever beam 205
995 Pivotal link connection on the second primary pivotal member 960 that is positioned in-between the fourth handle structure 825 and the fourth arm 970
1000 Attaching the attachment element 335 to the upper torso portion 65 of the user 60
1005 Attaching the attachment element 335 to the hip portion 70 of the user 60
1010 Grasping manually the third 755 and fourth handle structures 825 by the user 60 while standing
1015 Raising entire structural brace apparatus 55
1020 First 140 and second 205 telescoping cantilever beams away from the surface 105

DETAILED DESCRIPTION

Figure 2:
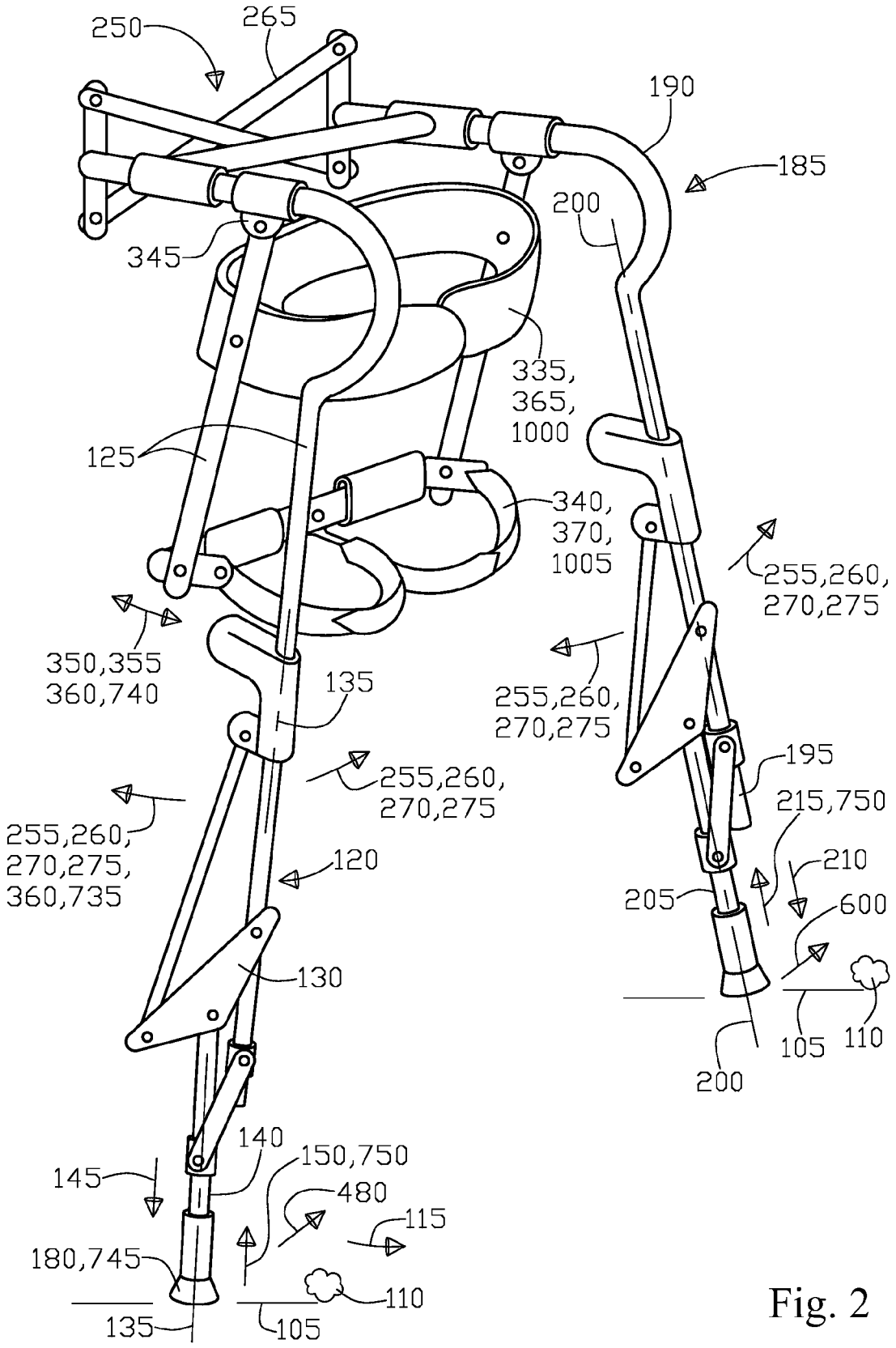
FIG. 2 shows a perspective view of a crutch apparatus noting in particular the attachment element with the user upper torso removable engagement and the user hip portion removable engagement along with the secondary pivotal movement and plane, plus a mechanism, a primary pivotal couple, primary pivotal movement and plane.

With initial reference to FIG. 1 shows a perspective view of a substitute structural brace apparatus 56. Next, FIG. 2 shows a perspective view of a crutch apparatus noting in particular the attachment element 335 with the user 60 upper torso 65 removable engagement 365 and the user 60 hip portion 70 removable engagement 340 along with the secondary pivotal movement 350 and plane 355, plus a mechanism 265, a primary pivotal couple 250, primary pivotal movement 255 and plane 260. Next, FIG. 3 shows a side elevation view of the crutch apparatus in use with a user 60 noting in particular the attachment element 335 that is engaged with the user 60 upper torso 65 removable engagement 365 and the user 60 hip portion 70 that is engaged 340 with the attachment element 335 removable hip portion engagement 340 along with the attachment element 335 secondary pivotal movement 350 and plane 355, plus a mechanism 265, a primary pivotal couple 250, primary pivotal movement 255 and plane 260.

Figure 3:
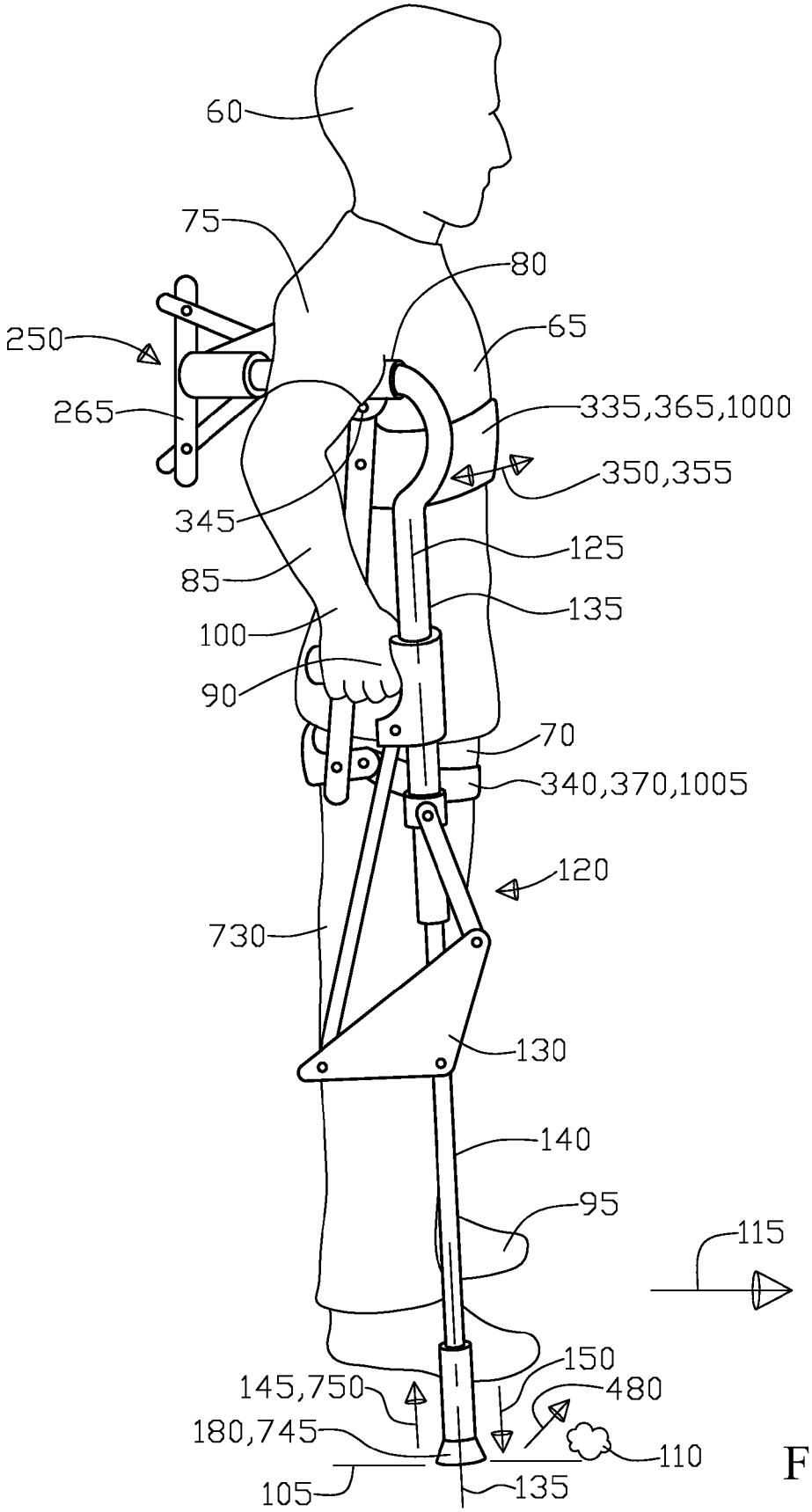
FIG. 3 shows a side elevation view of the crutch apparatus in use with a user noting in particular the attachment element that is engaged with the user upper torso removable engagement and the user hip portion that is engaged with the attachment element removable hip portion engagement along with the attachment element secondary pivotal movement and plane, plus a mechanism, a primary pivotal couple, primary pivotal movement and plane.
Figure 4:
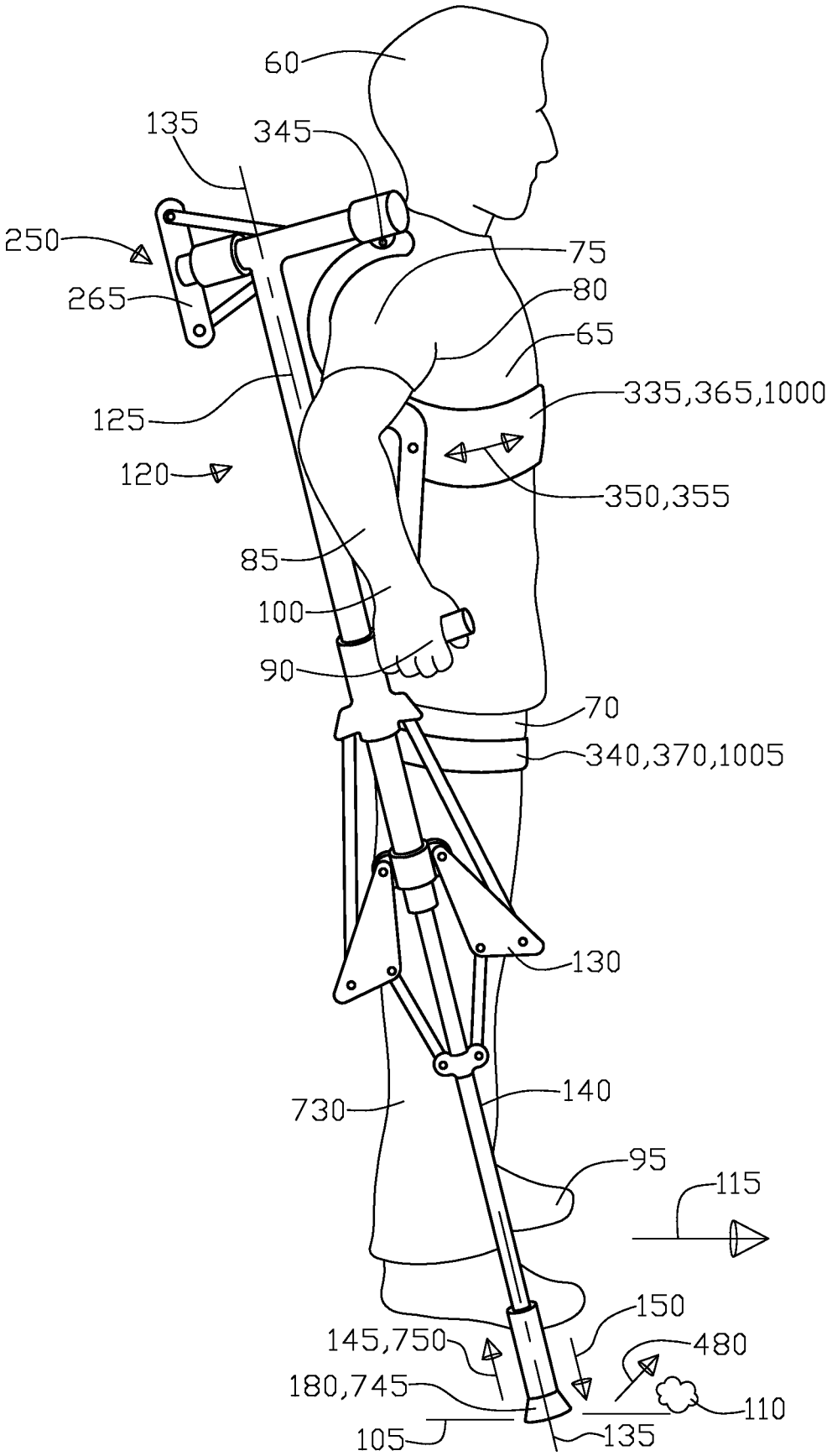
FIG. 4 shows a side elevation view of the crutch apparatus in use similar to FIG. 3 except for the user ambulating across the surface, with a user noting in particular the attachment element that is engaged with the user upper torso removable engagement and the user hip portion that is engaged with the attachment element removable hip portion engagement along with the attachment element secondary pivotal movement and plane, plus a mechanism, a primary pivotal couple, primary pivotal movement and plane.
Figure 5:
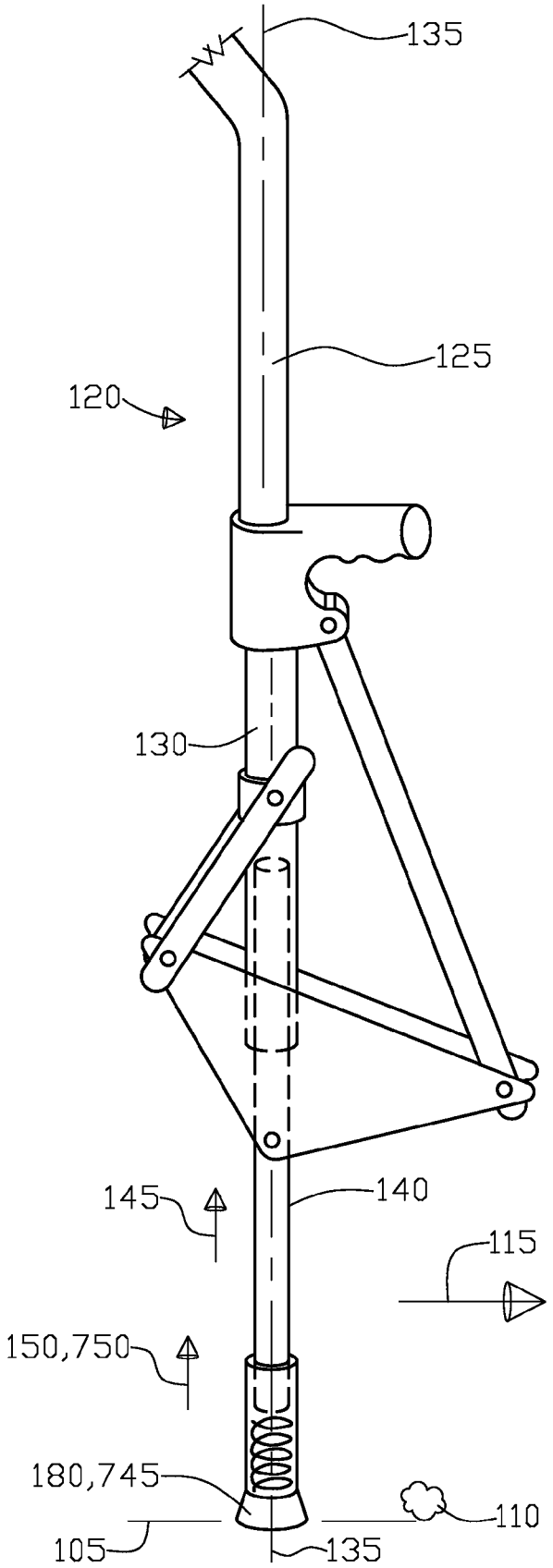
FIG. 5 shows a side elevation view showing in particular the crutch extension and retraction apparatus.
Figure 6:
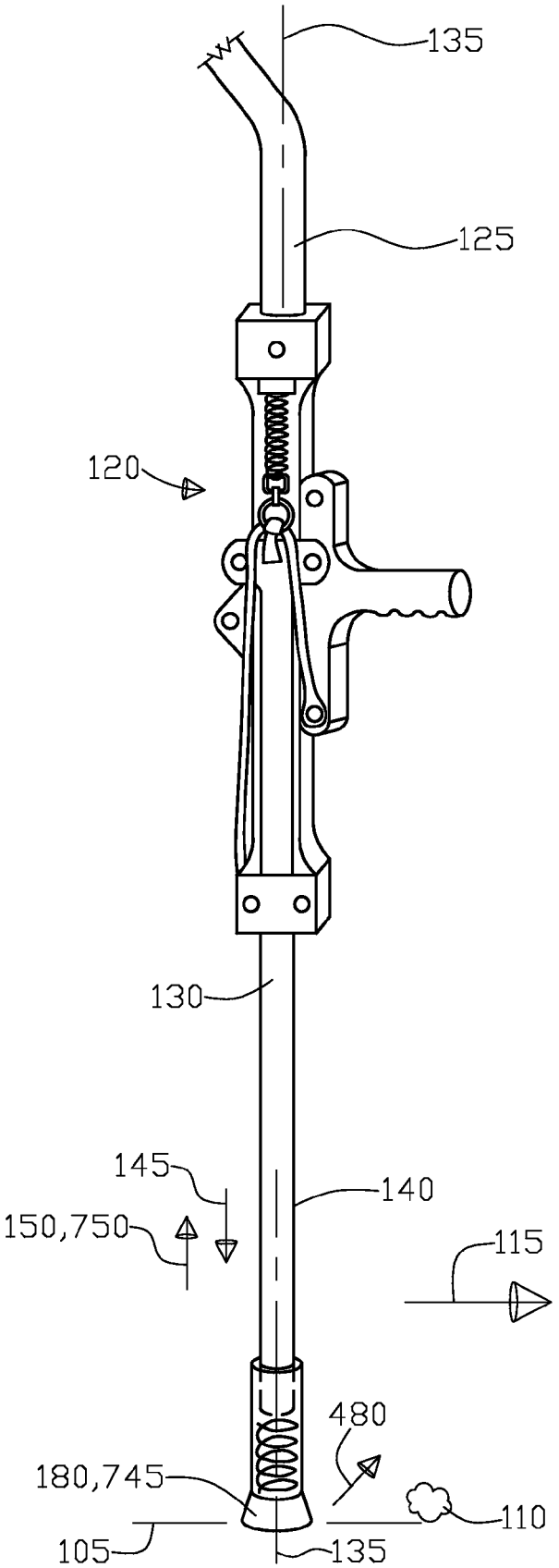
FIG. 6 shows another side elevation view showing in particular another crutch extension and retraction apparatus.

Continuing, FIG. 4 shows a side elevation view of the crutch apparatus in use similar to FIG. 3 except for the user 60 ambulating 115 across the surface 105, with the user 60, noting in particular the attachment element 335 that is engaged with the user upper torso 65 removable engagement 365 and the user 60 hip portion 70 that is engaged 340 with the attachment element 335 removable hip portion engagement 340 along with the attachment element 335 secondary pivotal movement 350 and plane 355, plus the mechanism 265, the primary pivotal couple 250, primary pivotal movement 255 and plane 260. Next, FIG. 5 shows a side elevation view showing in particular the crutch extension and retraction apparatus and FIG. 6 shows another side elevation view showing in particular another crutch extension and retraction apparatus.

Figure 7:
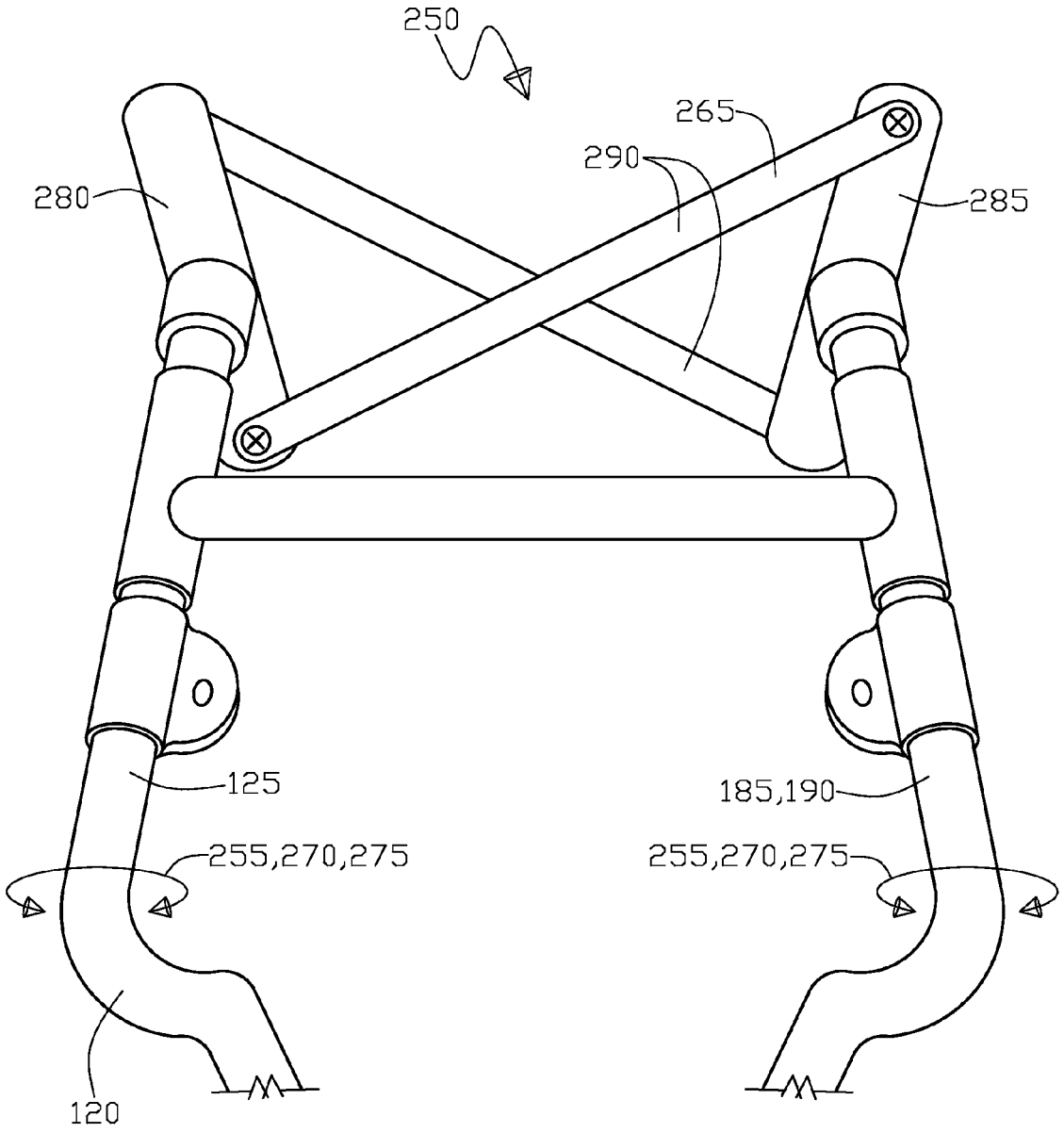
FIG. 7 shows a perspective view of the primary pivotal couple that pivotally connects a first and second support extension beams along with the mechanism for controlling the symmetric primary pivotal movement using first and second finger extensions and a linkage.
Figure 8:
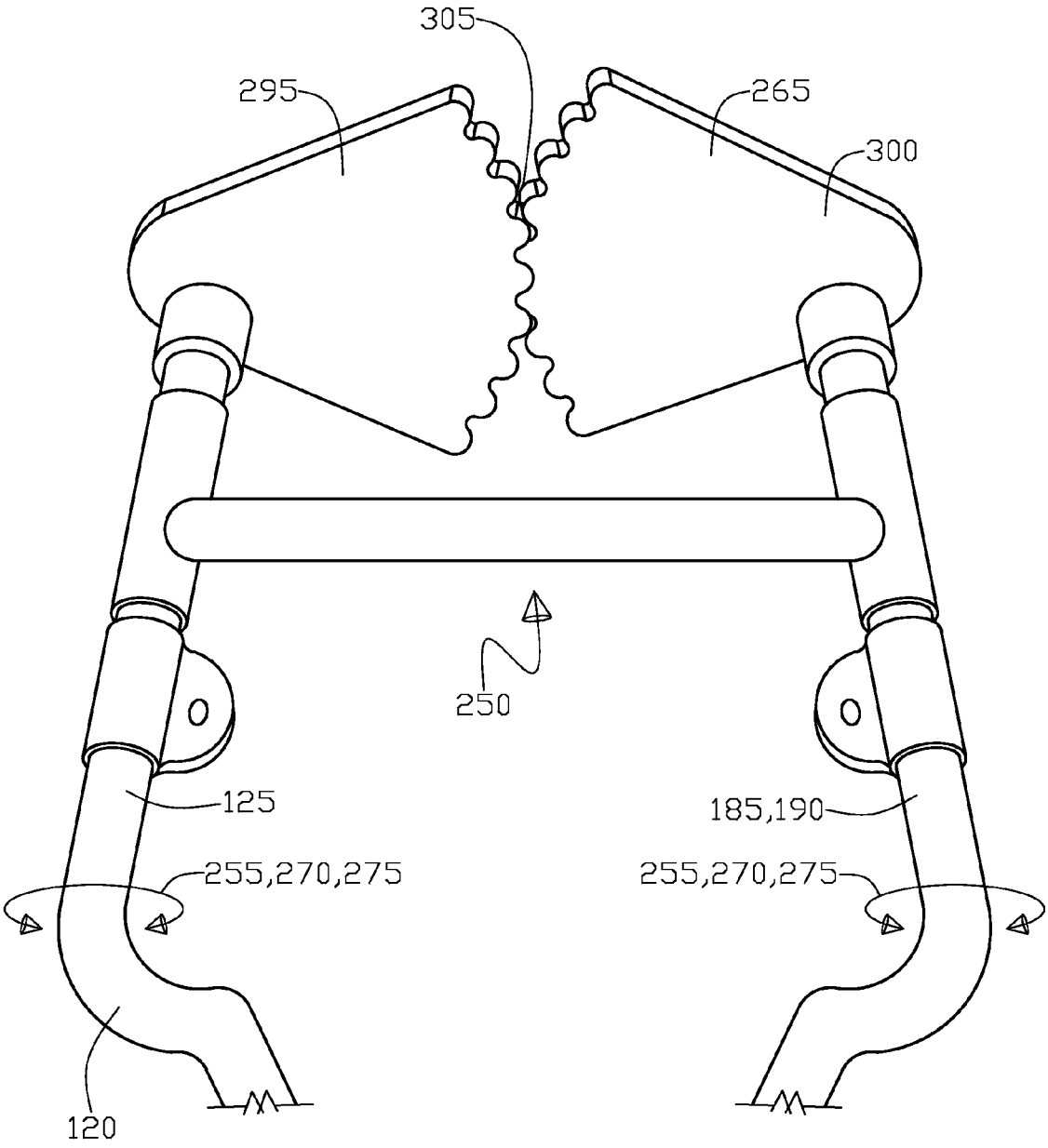
FIG. 8 shows a perspective view of the primary pivotal couple that pivotally connects a first and second support extension beams along with the mechanism for controlling the symmetric primary pivotal movement using first and second toothed segment extensions having a rotatable engagement between one another.
Figure 9:
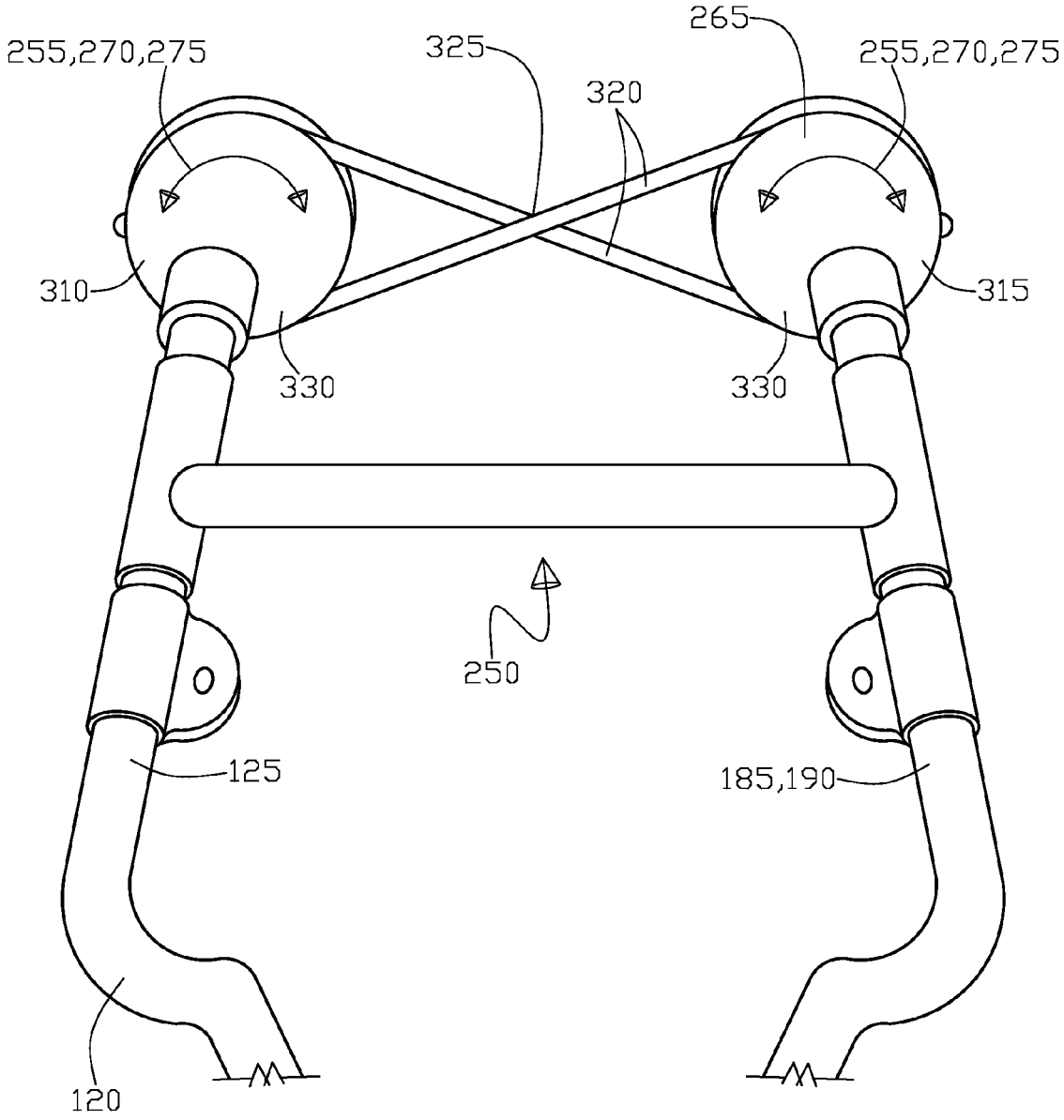
FIG. 9 shows a perspective view of the primary pivotal couple that pivotally connects a first and second support extension beams along with the mechanism for controlling the symmetric primary pivotal movement using first and second pulleys and a flexible element.

Further, FIG. 7 shows a perspective view of the primary pivotal couple 250 that pivotally connects a first 120 and a second 185 support extension beams along with the mechanism 265 for controlling the symmetric primary pivotal movement 270 using first 280 and second 285 finger extensions and a linkage 290. Next, FIG. 8 shows a perspective view of the primary pivotal couple 250 that pivotally connects the first 120 and second 185 support extension beams along with the mechanism 265 for controlling the symmetric primary pivotal movement 270 using first 295 and second 300 toothed segment extensions having a rotatable engagement 305 between one another. Continuing, FIG. 9 shows a perspective view of the primary pivotal couple 250 that pivotally connects the first 120 and second 185 support extension beams along with the mechanism 265 for controlling the symmetric primary pivotal movement 270 using first 310 and second 315 pulleys and a flexible element 320.

Figure 10:
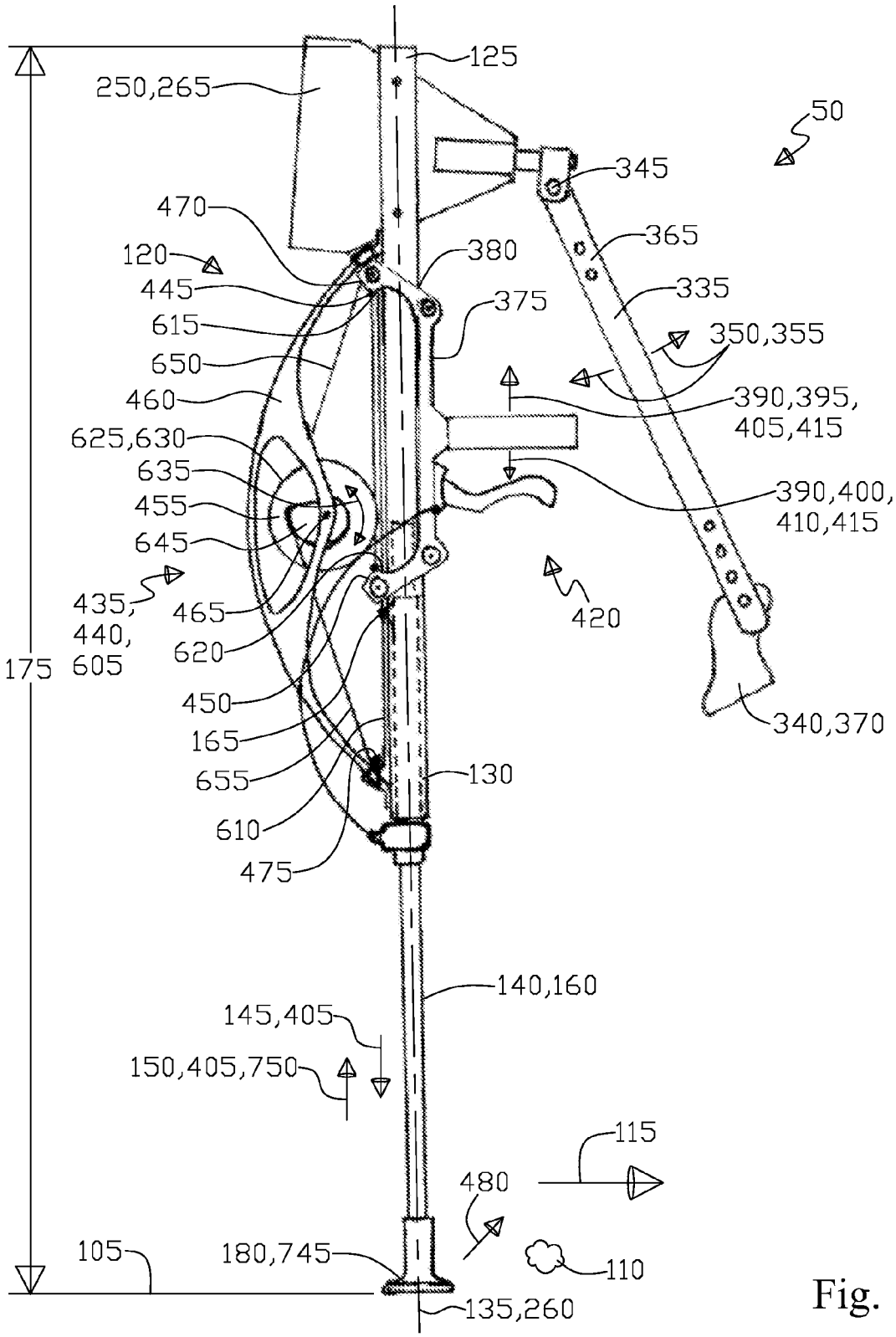
FIG. 10 shows a side elevation view of the external structural brace apparatus focusing in particular on the first support extension beam with the pivotal couple, the mechanism, and the attachment element, and specifically on a first means for facilitating same controlled direction movement as between the first handle structure and the first telescoping cantilever beam in relation to the surface all in the retracted operational state.
Figure 11:
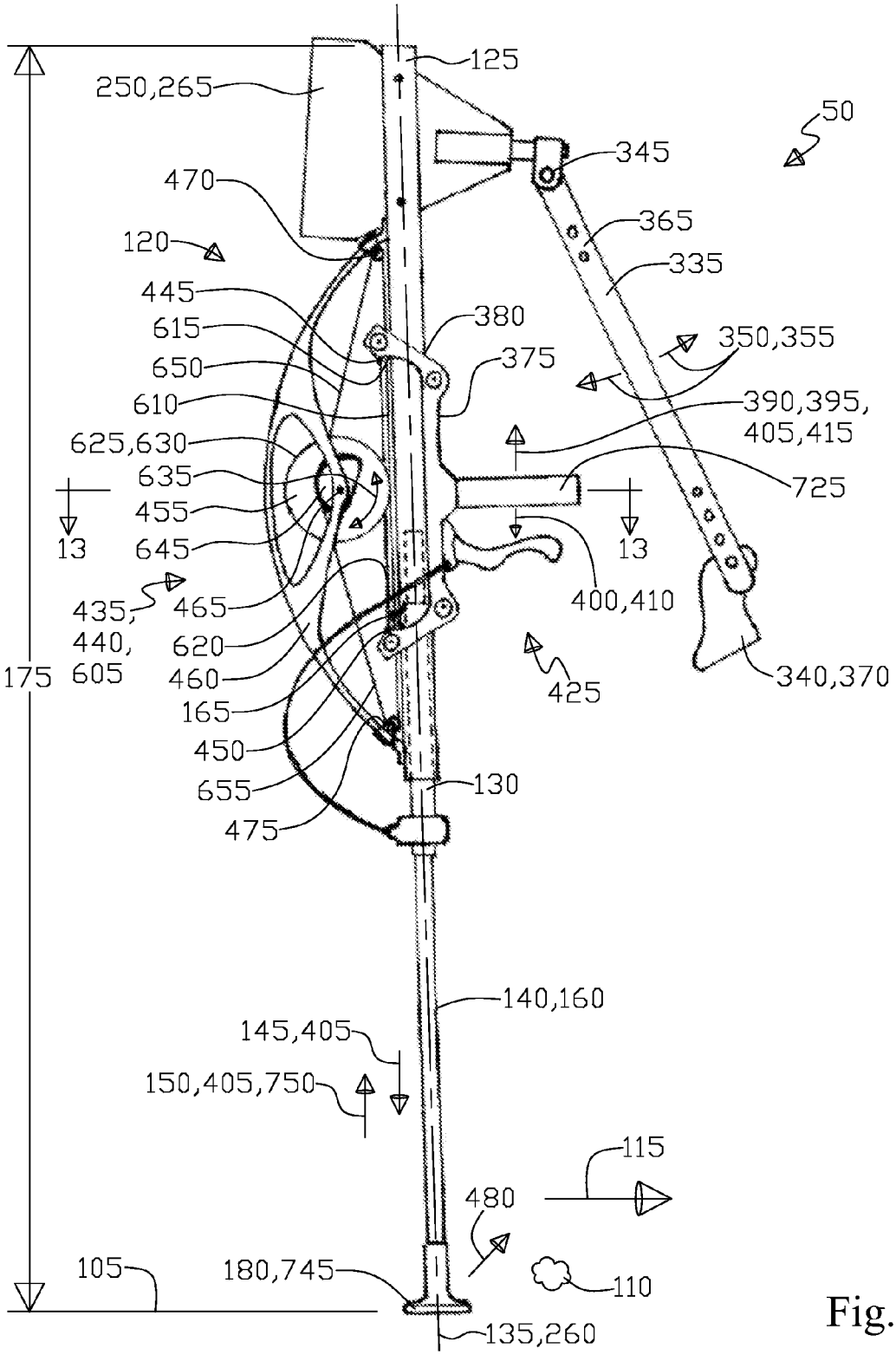
FIG. 11 shows a side elevation view of the external structural brace apparatus focusing in particular on the first support extension beam with the pivotal couple, the mechanism, and the attachment element, and specifically on a first means for facilitating same controlled direction movement as between the first handle structure and the first telescoping cantilever beam in relation to the surface all in the midpoint operational state.
Figure 12:
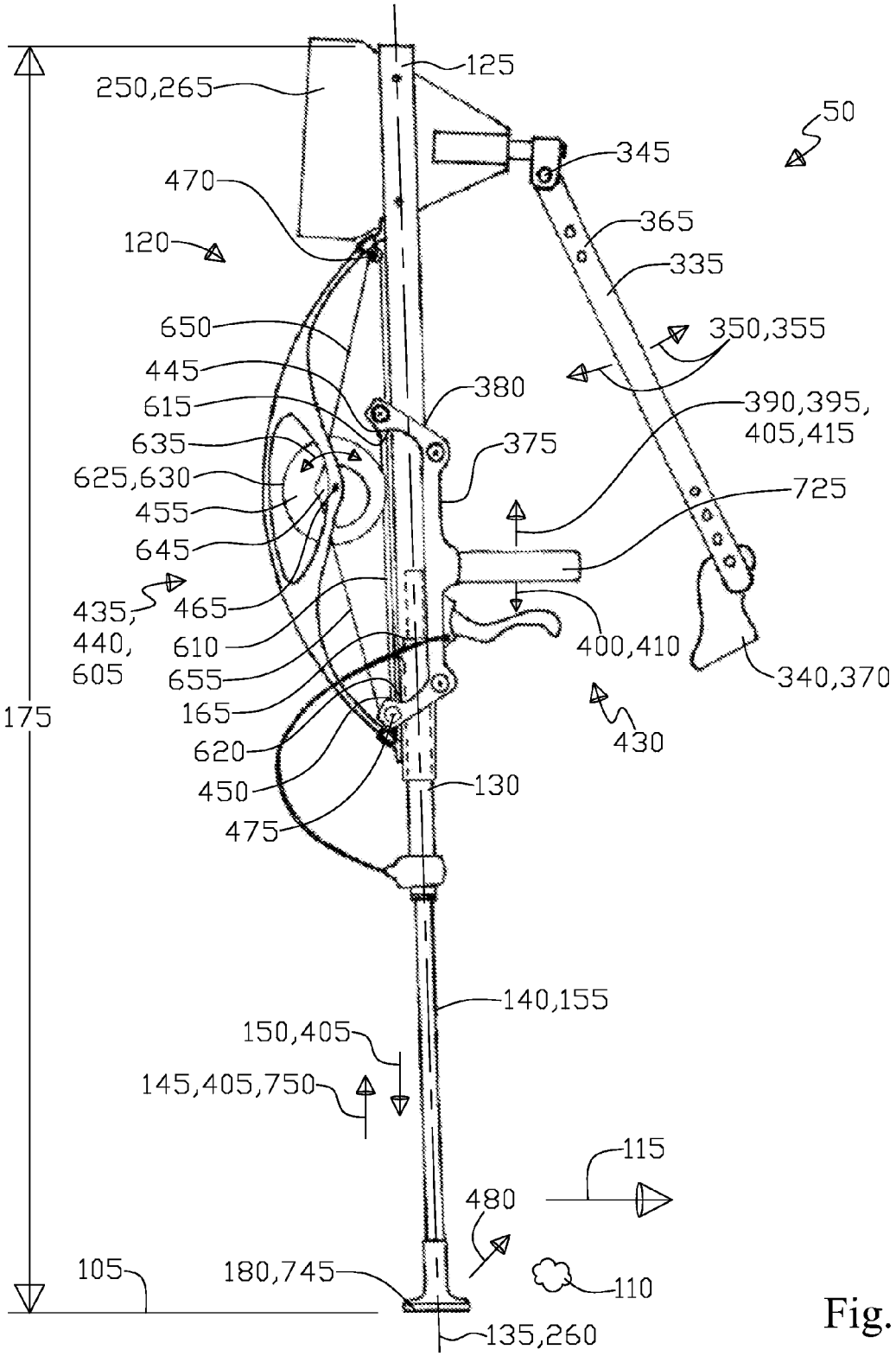
FIG. 12 shows a side elevation view of the external structural brace apparatus focusing in particular on the first support extension beam with the pivotal couple, the mechanism, and the attachment element, and specifically on a first means for facilitating same controlled direction movement as between the first handle structure and the first telescoping cantilever beam in relation to the surface all in the extended operational state.

Moving onward, FIG. 10 shows a side elevation view of the external structural brace apparatus 50 focusing in particular on the first support extension beam 120 with the pivotal couple 250, the mechanism 265, and the attachment element 335, and specifically on a first means 605 for facilitating same controlled direction movement 405 as between the first handle structure 375 and the first telescoping cantilever beam 140 in relation to the surface 105 all in the retracted operational state 420. Next, FIG. 11 shows a side elevation view of the external structural brace apparatus 50 focusing in particular on the first support extension beam 120 with the pivotal couple 250, the mechanism 265, and the attachment element 335, and specifically on the first means 605 for facilitating same controlled direction movement 405 as between the first handle structure 375 and the first telescoping cantilever beam 140 in relation to the surface 105 all in the midpoint operational state 425. Further, FIG. 12 shows a side elevation view of the external structural brace apparatus 50 focusing in particular on the first support extension beam 120 with the pivotal couple 250, the mechanism 265, and the attachment element 335, and specifically on the first means 605 for facilitating same controlled direction movement 405 as between the first handle structure 375 and the first telescoping cantilever beam 140 in relation to the surface 105 all in the extended operational state 430.

Figure 13:
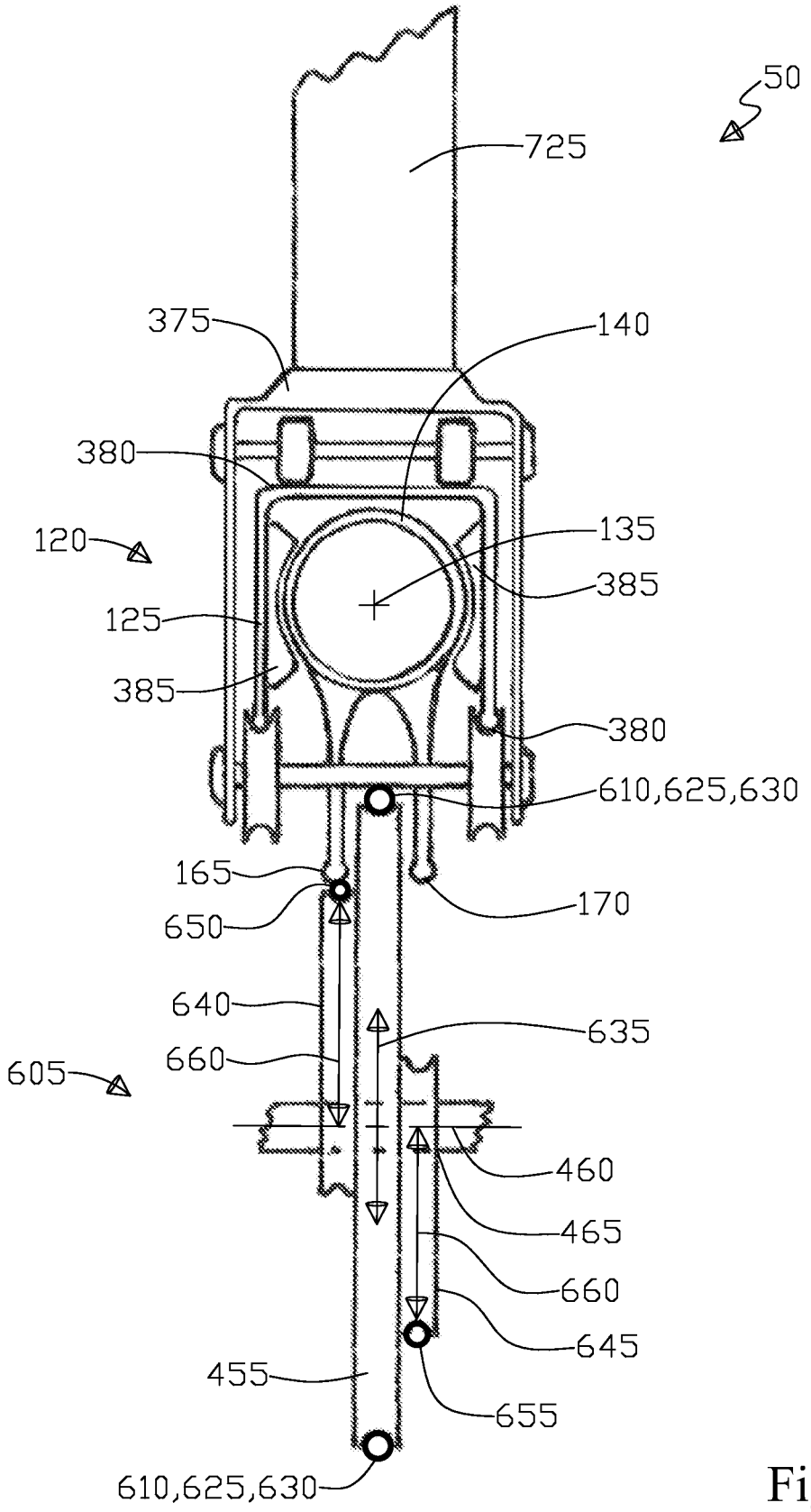
FIG. 13 shows cross section view 13-13 as taken from FIG. 11 taken at the pulley centerline showing in particular detail on the first handle structure slidable engagement being on the proximal end portion of the first support extension beam, further shown are saddles for the slidable engagement, a first arm, the pulley, an eccentric retraction segment, an eccentric extension segment, a first flexible component, a flexible loop, a flexible retraction component, a flexible extension component, and the telescoping cantilever beam with its retraction connection and extension connection.

Continuing, FIG. 13 shows cross section view 13-13 as taken from FIG. 11 taken at the pulley 455 centerline showing in particular detail on the first handle structure 375 slidable engagement 380, 490 on the proximal end portion 125 of the first support extension beam 120, further shown are saddles 385, 495 for the slidable engagement 380, 490 the first arm 460, the pulley 455, an eccentric retraction segment 640, an eccentric extension segment 645, a first flexible component 610, a flexible loop 625, a flexible retraction component 650, a flexible extension component 655, and the telescoping cantilever beam 140 with its retraction connection 165 and extension connection 170.

Figure 14:
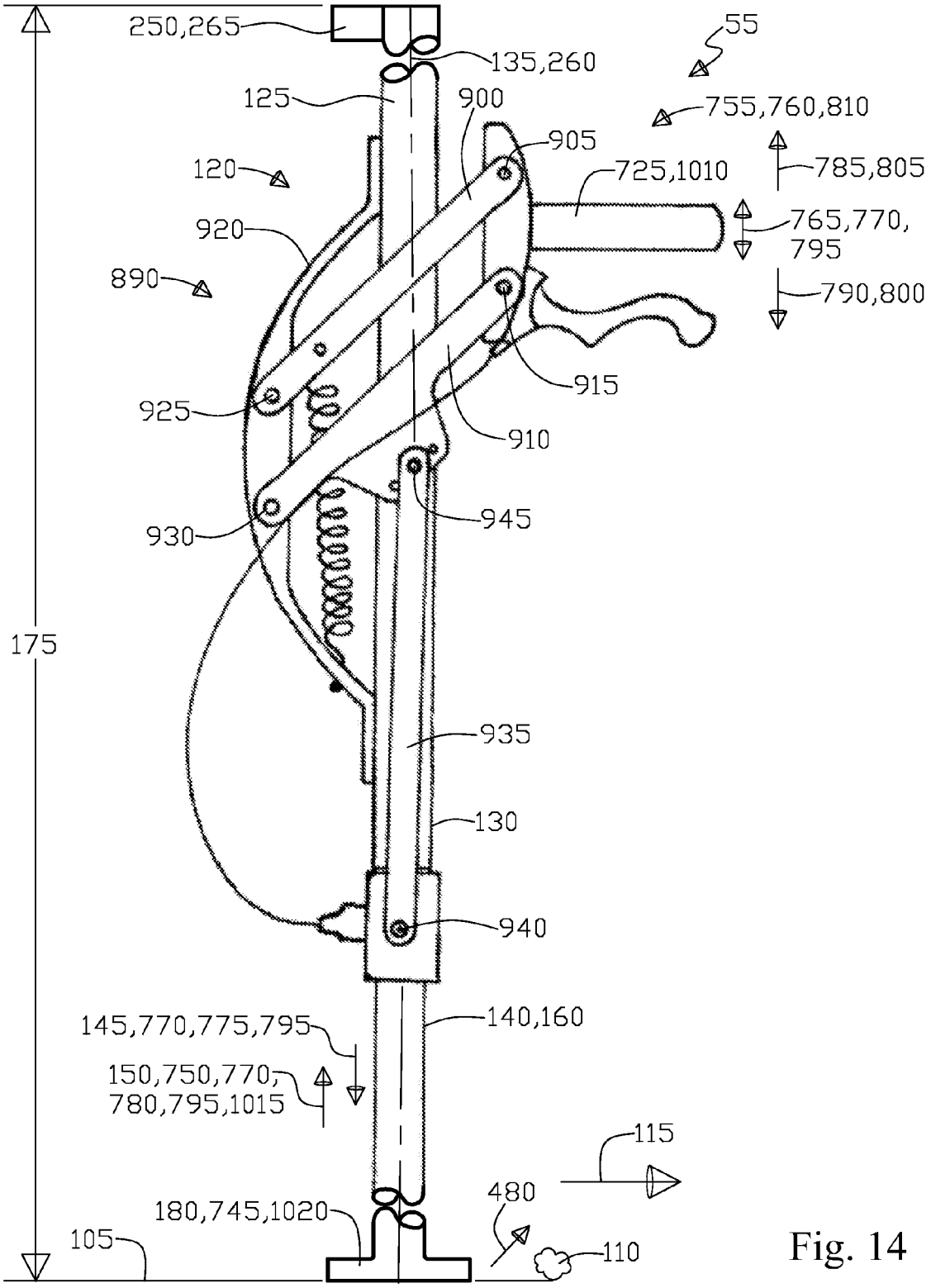
FIG. 14 shows a side elevation view of the alternative embodiment of the structural brace apparatus focusing in particular on the first support extension beam with the pivotal couple, the mechanism, and the attachment element, and specifically on a third means for facilitating same controlled direction movement as between the third handle structure and the first telescoping cantilever beam in relation to the surface all in the retracted operational state.
Figure 15:
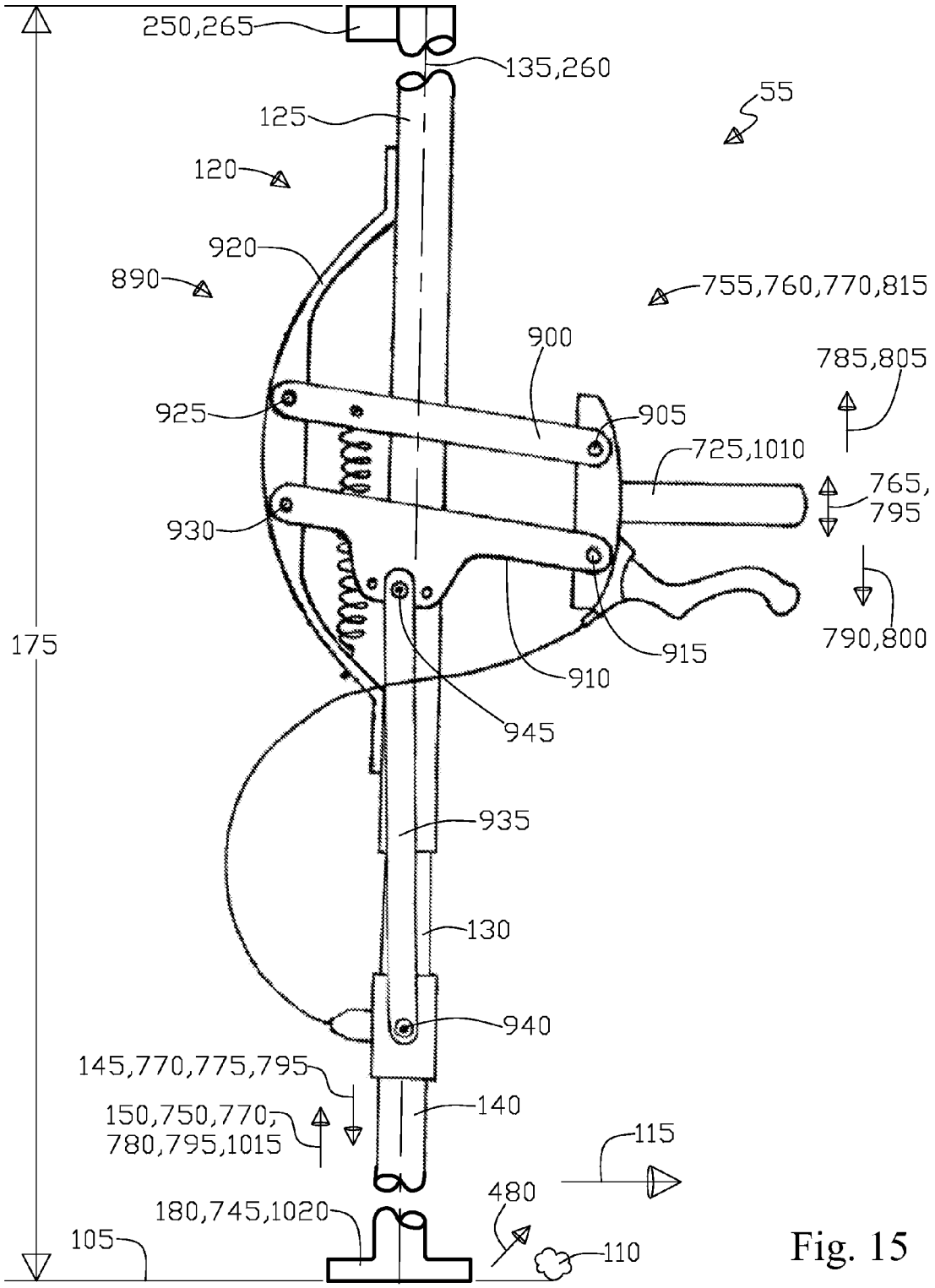
FIG. 15 shows a side elevation view of the alternative embodiment of the structural brace apparatus focusing in particular on the first support extension beam with the pivotal couple, the mechanism, and the attachment element, and specifically on a third means for facilitating same controlled direction movement as between the third handle structure and the first telescoping cantilever beam in relation to the surface all in the midpoint operational state.
Figure 16:
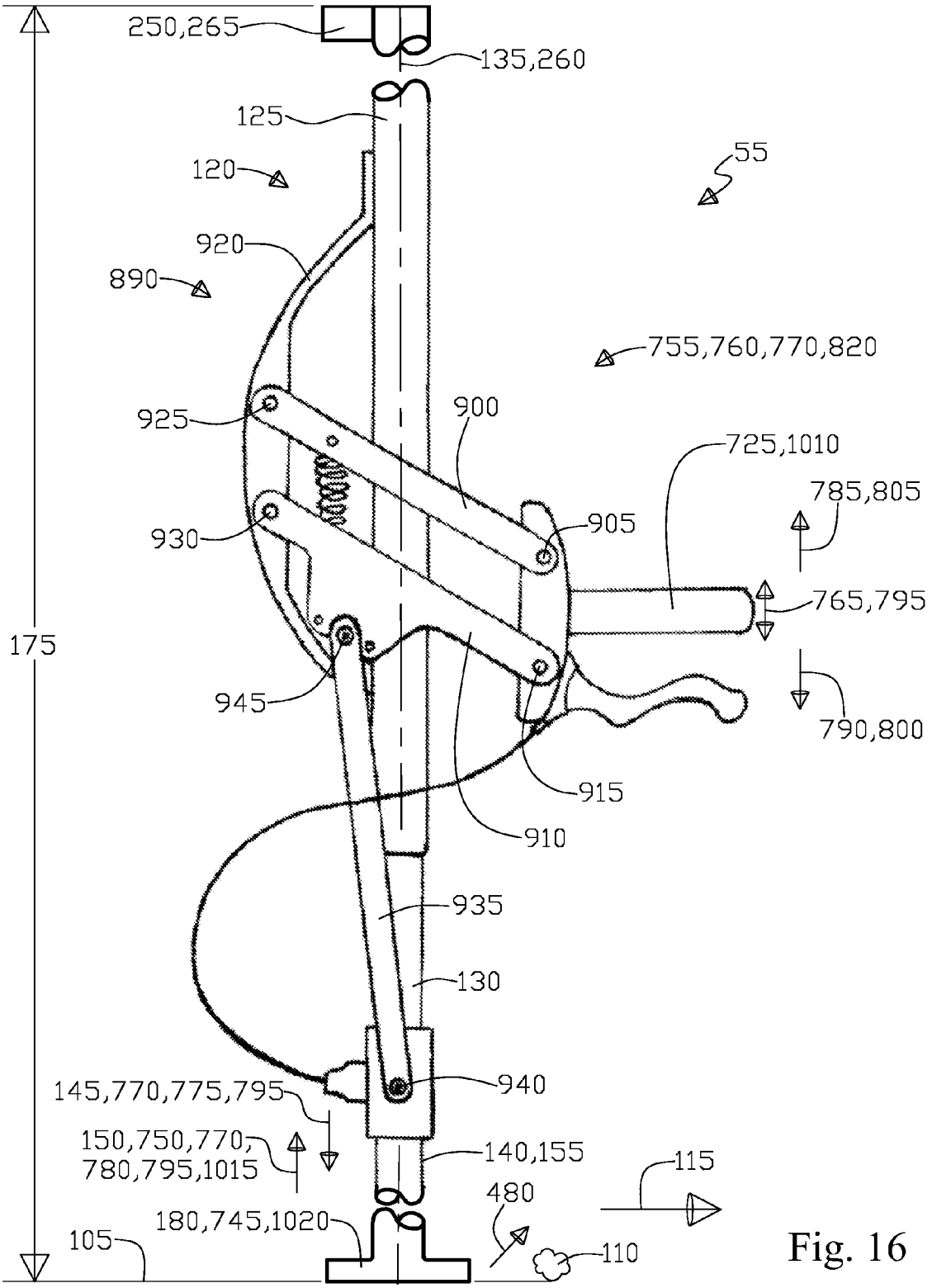
FIG. 16 shows a side elevation view of the alternative embodiment of the structural brace apparatus focusing in particular on the first support extension beam with the pivotal couple, the mechanism, and the attachment element, and specifically on a third means for facilitating same controlled direction movement as between the third handle structure and the first telescoping cantilever beam in relation to the surface all in the extended operational state.

Next, FIG. 14 shows a side elevation view of the alternative embodiment 55 of the structural brace apparatus focusing in particular on the first support extension beam 120 with the pivotal couple 250, the mechanism 265, and the attachment element 335, and specifically on a third means 890 for facilitating same controlled direction movement 770 as between the third handle structure 755 and the first telescoping cantilever beam 140 in relation to the surface 105 all in the retracted operational state 810. Continuing, FIG. 15 shows a side elevation view of the alternative embodiment 55 of the structural brace apparatus focusing in particular on the first support extension beam 120 with the pivotal couple 250, the mechanism 265, and the attachment element 335, and specifically on a third means 890 for facilitating same controlled direction movement 770 as between the third handle structure 755 and the first telescoping cantilever beam 140 in relation to the surface 105 all in the midpoint operational state 815. Further, FIG. 16 shows a side elevation view of the alternative embodiment 55 of the structural brace apparatus focusing in particular on the first support extension beam 120 with the pivotal couple 250, the mechanism 265, and the attachment element 335, and specifically on a third means 890 for facilitating same controlled direction movement 770 as between the third handle structure 755 and the first telescoping cantilever beam 140 in relation to the surface 105 all in the extended operational state 820.

Broadly as best shown in FIGS. 2, 3, and 7 through 13, the external structural brace apparatus 50 for supporting a user 60 on a surface 105 and for the user 60 to ambulate 115 along the surface 105 to relieve shoulder 75, armpit 80, hand 90, foot 95, and wrist 100 loads for the user 60, the external structural brace apparatus 50 includes a first support extension beam 120 having a first proximal end portion 125 and an opposing first distal end portion 130 and a first longitudinal axis 135 spanning therebetween. The first distal end portion 130 including a first telescoping cantilever beam 140 having extension 145 and retraction 150 movement along the first longitudinal axis 135 to vary a total length 175 of the first support extension beam 120, wherein the first telescoping cantilever beam 140 has intermittent contact 180 with the surface 105, see in particular FIGS. 10 through 12.

The external structural brace apparatus 50 also includes a second support extension beam 185 having a second proximal end portion 190 and an opposing second distal end portion 195 and a second longitudinal axis 200 spanning therebetween. The second distal end portion 195 including a second telescoping cantilever beam 205 having extension 210 and retraction 215 movement along the second longitudinal axis 200 to vary a total length 240 of the second support extension beam 185. Wherein the second telescoping cantilever beam 205 has intermittent contact 245 with the surface 105, wherein the first 125 and second 190 proximal end portions have a primary pivotal couple 250 to one another, wherein the first 120 and second 185 support extension beams are limited to have a primary pivotal movement 255 relative to one another in a single primary radial plane 260, see FIGS. 2 and 7 through 9 for detail.

Also included in the external structural brace apparatus 50 is a mechanism 265 affixed therebetween the first 125 and second 190 proximal end portions that causes the primary pivotal movement 255 to be symmetrical 270 as between the first 130 and second 195 distal end portions in equal and opposite directions 275, wherein a single primary pivotal movement 260 initiated at the first distal end portion 130 causes an automatic equal and opposite primary pivotal movement 275 of the second distal end portion 195 and a single primary pivotal movement 260 initiated at the second distal end portion 195 causes an automatic equal and opposite primary pivotal movement 275 of the first distal end portion 130, see in particular FIGS. 2 and 7 through 9 for detail.

Further included in the external structural brace apparatus 50 is an attachment element 335 structure that has a secondary pivotal connection 345 to the first 125 and second 190 proximal end portions, allowing a secondary pivotal movement 350 that is limited to a single secondary pivotal movement plane 355 that is oriented in a perpendicular 360 manner to the primary radial plane 260, wherein the attachment element structure 335 is sized and configured 365 to removably engage an upper torso portion 65 of the user 60, see FIGS. 2 through 4 and 10 through 12.

Also included in the external structural brace apparatus 50 is a first handle structure 375 that has a first slidable engagement 380 on the first proximal end portion 125, wherein the first slidable engagement 380 has movement 390 along the first longitudinal axis 135, as shown in FIGS. 10 through 12. Further, a second handle structure 485 that has a second slidable engagement 490 on the second proximal end portion 190, wherein the second slidable engagement 490 has movement 500 along the second longitudinal axis 200.

Further included in the external structural brace apparatus 50 is a first means 605 for facilitating same direction movement 405 of the first handle structure 375 and the first telescoping cantilever beam 140, wherein there is a decreasing mechanical advantage 550 as between the first handle structure 375 and the first telescoping cantilever beam 140, as the first handle structure 375 is manually pushed downward 410 toward the first telescoping cantilever beam 140 to accommodate an arm 85 of the user 60 gaining strength as the arm 85 is extended toward the first telescoping cantilever beam 140. Further the first means 605 includes an increasing speed of retraction movement 440 of the first telescoping cantilever beam 140 as the first handle structure 375 is manually pulled away 415 from the first telescoping cantilever beam 140 to help the first telescoping cantilever beam 140 better clear obstacles 110 on the surface 105 for the user 60 to ambulate 115 along the surface 105, as best shown in FIGS. 2 through 4 and 10 through 12.

In addition, included in the external structural brace apparatus 50 is a second means 665 for facilitating same direction movement 505, 520 of the second handle structure 485 and the second telescoping cantilever beam 205, wherein there is a decreasing mechanical advantage 550 as between the second handle structure 485 and the second telescoping cantilever beam 205, as the second handle structure 485 is manually pushed toward 525 the second telescoping cantilever beam 205, to accommodate an arm 85 of the user 60 gaining strength as the arm 85 is extended toward the second telescoping cantilever beam 205. Further there is an increasing speed of retraction movement 555 of the second telescoping cantilever beam 205 as the second handle structure 485 is manually pulled away 530 from the second telescoping cantilever beam 205 to help the second telescoping cantilever beam 205 better clear obstacles 110 on the surface 105 for the user 60 to ambulate 115 along the surface 105, as best shown in FIGS. 2 through 4 and 10 through 12.

Wherein operationally, the user 60 is engaged to the attachment element structure 335 at the user's 60 upper torso portion 65, further the user 60 utilizes each one of their hands 90 to manually grasp 725 each one of the first 375 and second 485 handle structures wherein the user 60 while standing with their hands 90 manually moves the first 120 and second 185 support extensions that are connected via the mechanism 265 in the primary pivotal movement 275 to place the first 140 and second 205 telescoping cantilever beams in contact with the surface 105 for user 60 stability in the single primary radial plane 260, see FIGS. 2 through 4 and FIGS. 7 through 9. At this point the user 60 is able to assume a seated position being supported on the surface 105 by the first 140 and second 205 telescoping cantilever beams, further the user 60 can ambulate 115 across the surface 105 via standing while simultaneously the user 60 pushing downward 410, 525 on the first 375 and second 485 handle structures that pushes downward on the first 140 and second 205 telescoping cantilever beams as the user's 60 arms 85 are extended to raise the entire external structural brace apparatus 50, thus assisting the user 60 to stand, see FIGS. 3 and 4. At which point the user 60 pulls upward 415, 530 on the first 375 and second 485 handle structures resulting in the first 140 and second 205 telescoping cantilever beams lifting 750 from the surface 105 with the user 60 then momentarily balancing on their foot 95 on the surface 105, and subsequently the user 60 utilizing the primary 255 and secondary 350 pivotal movements to selectively reposition the first 140 and second 205 telescoping cantilever beams on the surface 105 with the user 60 then pushing downward 410, 525 on the first 375 and second 485 handle structures to have the first 140 and second 205 telescoping cantilever beams contact 745 the surface 105 with the user 60 then repositioning their foot 95 on the surface 105 for balance, as shown in FIGS. 3, 4, and 10 through 12.

The attachment element structure 335 further comprises framework 340 that is sized and configured 370 to removably engage the hip portion 70 of the user 60 to add stability and comfort for the user 60 in sitting and standing with the attachment element 335 through the secondary pivotal connection 345 to the first 120 and second 185 support extension beams, see FIGS. 2 through 4 and 10 through 12.

Further on the mechanism 265 it is preferably constructed of a first finger extension 280 affixed to the first proximal end portion 125 and a second finger extension 285 affixed to the second proximal end portion 190, wherein the first 280 and second 285 finger extensions are oppositely disposed from one another, further a linkage 290 is pivotally connected between the first 280 and second 285 finger extensions to operationally cause the primary pivotal movement 275 between the first 120 and second 185 support extension beams to be oppositely symmetric for increased stability of the user 60 suspended via the attachment element 335 in relation to the surface 105, see FIG. 7 in particular and FIGS. 2 through 4 and 10 through 12.

Additionally on the mechanism 265 it can be optionally constructed of a first toothed segment extension 295 affixed to the first proximal end portion 125 and a second toothed segment extension 300 affixed to the second proximal end portion 190, wherein the first 295 and second 300 toothed segment extensions are rotatably engaged 305 to one another via meshing teeth to operationally cause the primary pivotal movement 275 between the first 120 and second 185 support extension beams to be oppositely symmetric for increased stability of the user 60 suspended via the attachment element 335 in relation to the surface 105, as best shown in FIG. 8 in particular and FIGS. 2 through 4 and 10 through 12.

Further on the mechanism 265 it can also be optionally constructed of a first pulley 310 affixed to the first proximal end portion 125 and a second pulley 315 affixed to the second proximal end portion 190, wherein the first 310 and second 315 pulleys are rotatably engaged 330 to one another via a flexible element 320 that is configured in a crossover X pattern 325 between the first 310 and second 315 pulleys to operationally cause the primary pivotal movement 275 between the first 120 and second 185 support extension beams to be oppositely symmetric for increased stability of the user 60 suspended via the attachment element 335 in relation to the surface 105, as best shown in FIG. 9 in particular and FIGS. 2 through 4 and 10 through 12.

Looking at FIGS. 10 through 13, the first means 605 is preferably structurally constructed of a first flexible component 610 having a first flexible retraction end 615 and an opposing first flexible extension end 620 forming a first flexible loop 625 therebetween, wherein the first handle structure 375 includes a first handle retraction end 445 and a first handle extension end 450, wherein the first flexible retraction end 615 is attached to the first handle retraction end 445 and the first flexible extension end 620 is attached to the first handle extension end 450. Also on the first means 605, the first flexible loop 625 is circumferentially contacting 630 a first handle pulley 455 that is rotatably mounted 465 on a first arm 460 of the first proximal end portion 130, the first flexible component 610 converts the first handle 375 first slidable engagement 380 extension 400 and retraction 395 movement into a first handle 375 rotational extension and retraction movement 635, the first handle pulley 455 further includes a rotationally coupled first eccentric periphery retraction segment 640 and a rotationally coupled first eccentric periphery extension segment 645.

Also for the first means 605 the first telescoping cantilever beam 140 includes a first retraction connection 165 and a first extension connection 170, a first flexible retraction component 650 is engaged to the first eccentric periphery retraction segment 640 and to the first retraction connection 165, a first flexible extension component 655 is engaged to the first eccentric periphery extension segment 645 and to the first extension connection 170. Wherein operationally the first eccentric periphery retraction 640 and extension 645 segments vary an effective moment arm 660 in converting the first handle 375 rotational extension 400 and retraction 395 movement 635 into the first telescoping cantilever beam 140 decreasing mechanical advantage 435, 550 extension movement 145 when the first handle 375 is going from a retracted state 420, to a midpoint state 425, and to an extended state 430, from a decreasing moment arm 660 caused by the first eccentric extension segment 645, see in particular in going from FIGS. 10 to 11 to 12. Also an increasing speed 440 of retraction movement 150 when the first handle 375 is going from an extended state 430, to a midpoint state 425, and to a retracted state 420 from an increasing moment arm 660 caused by the first eccentric retraction segment 640.

Further, the first flexible component 610, the first flexible retraction component 650, and the first flexible extension component 655 are all preferably constructed of cable. Also on the first arm 460 further includes a first flexible retraction component guide 470 and a first flexible extension component guide 475 to operationally extend a range of the extension 145 and retraction 150 movement of said first telescoping cantilever beam 140, see FIGS. 10, 11, and 12 in particular.

Looking at FIGS. 10 through 13, the second means 665 is preferably structurally constructed of a second flexible component 670 having a second flexible retraction end 675 and an opposing second flexible extension end 680 forming a second flexible loop 685 therebetween, wherein the second handle structure 485 includes a second handle retraction end 560 and a second handle extension end 565, wherein the second flexible retraction end 675 is attached to the second handle retraction end 560 and the second flexible extension end 680 is attached to the second handle extension end 565, with the second flexible loop 685 circumferentially contacting 690 a second handle pulley 570 that is rotatably mounted 580 on a second arm 575 of the second distal end portion 195. The second flexible component 670 converts the second handle 485 second slidable engagement 490 extension 515 and retraction 510 movement into a second handle 485 rotational 700 extension 515 and retraction 510 movement, the second handle pulley 570 further includes a rotationally coupled second eccentric periphery retraction segment 705 and a rotationally coupled second eccentric periphery extension segment 710, the second telescoping cantilever beam 205 includes a second retraction connection 230 and a second extension connection 235, a second flexible retraction component 715 is engaged to the second eccentric periphery retraction segment 705 and to the second retraction connection 230, a second flexible extension component 720 is engaged to the second eccentric periphery extension segment 710 and to the second extension connection 235.

Wherein operationally the second eccentric periphery retraction 705 and extension 710 segments vary an effective moment arm 660 in converting the second handle 485 rotational 700 extension 515 and retraction 510 movement into the second telescoping cantilever beam 205 decreasing mechanical advantage 550 extension movement 210 when the second handle 485 is going from a retracted state 535, to a midpoint state 540, and to an extended state 545 from a decreasing moment arm 660 caused by the first eccentric extension segment 710 and increasing speed of retraction movement 555 when the second handle 485 is going from an extended state 545, to a midpoint state 540, and to a retracted state 535 from an increasing moment arm 660 caused by the second eccentric retraction segment 705.

Further, the second flexible component 670, the second flexible retraction component 715, and the second flexible extension component 720 are all preferably constructed of cable. Also on the second arm 575 further includes a second flexible retraction component guide 585 and a second flexible extension component guide 590 to operationally extend a range of the extension 210 and retraction 215 movement of the second telescoping cantilever beam 205.

Due to the nature of FIGS. 10 through 13 showing primarily the "first" of a set of elements starting with the first support extension beam 120 and the fact that the external structural brace apparatus 50 utilizes a duplicate set of "second" elements starting with the second support extension beam 185, the second grouping is not necessarily shown in the Figures as it would be duplicative with no new matter disclosed, thus the "first" group of elements being 120, 125, 130, 135, 140, 145, 150, 155, 160 165, 170, 175, 180, 375, 380 385, 390, 395, 400, 405, 410, 415, 420, 425, 430, 435, 440, 445, 450, 455, 460, 465, 470, 475, 480, 605, 610, 615, 620, 625, 630, 635, 640, 645, 650, 655, and 660 correspond to the "second" elements of 185, 190, 195, 200, 205, 210, 215, 220, 225, 230, 235, 240, 245, 485, 490, 495, 500, 505, 510, 515, 520, 525, 530, 535, 540, 545, 550, 555, 560, 565, 570, 575, 580, 585, 590, 665, 670, 675, 680, 685, 690, 695, 700, 705, 710, 715, and 720.

Broadly in focusing in FIGS. 14 through 16, the external structural brace apparatus 55 for supporting a user 60 on a surface 105 and for the user 60 to ambulate 115 along the surface 105 to relieve shoulder 75, armpit 80, hand 90, foot 95, and wrist 100 loads, the external structural brace apparatus 55 including the first support extension beam 120, the second support extension beam 185, the primary pivotal couple 250 to one another, the mechanism 265, the attachment structure 335, the secondary pivotal connection 345, all as previously described in this specification.

Additionally, what is unique to the external structural brace apparatus 55, is a third handle structure 755 that has a first pivotal engagement 760 on the first proximal end portion 125, wherein the first pivotal engagement 760 has movement 765 along the first longitudinal axis 135 and a fourth handle structure 825 that has a second pivotal engagement 830 on the second proximal end portion 190, wherein the second pivotal engagement 830 has movement 835 along the second longitudinal axis 200, all as best shown in FIGS. 14 through 16.

Continuing, the external structural brace apparatus 55 includes a third means 890 for facilitating same direction movement 770, 795 of the third handle structure 755 and the first telescoping cantilever beam 140, wherein there is a decreasing speed of relative movement 855 of the first telescoping cantilever beam 140 in relation to the third handle structure 755 movement 765, as the third handle structure 755 is manually pushed toward 800 the first telescoping cantilever beam 140, to accommodate the user 60 being able to more precisely position the first telescoping cantilever beam 140 on the surface 105 as the user's 60 arm 85 is extended toward 800 the first telescoping cantilever beam 140. Further the third means 890 accommodates an increasing speed of retraction movement 780 of the first telescoping cantilever beam 140 as the third handle structure 755 is manually pulled away 805 from the first telescoping cantilever beam 140 to help the first telescoping cantilever beam 140 better clear 480 obstacles 110 on the surface 105 for the user 60 to ambulate 115 along the surface 105, see FIGS. 2 through 4 and 14 through 16.

Further, the external structural brace apparatus 55 includes a fourth means 895 for facilitating same direction movement 850 of the fourth handle structure 825 and the second telescoping cantilever beam 205, wherein there is a decreasing speed of relative movement 855 of the second telescoping cantilever beam 205 in relation to the fourth handle structure 825 movement 835, as the fourth handle structure 825 is manually pushed toward 865 the second telescoping cantilever beam 205, to accommodate the user 60 being able to more precisely position the second telescoping cantilever beam 205 on the surface 105 as the user's 60 arm 85 is extended toward 845 the second telescoping cantilever beam 205. Further the fourth means accommodates an increasing speed of retraction movement 860 of the second telescoping cantilever beam 205 as the fourth handle structure 825 is manually pulled away 870 from the second telescoping cantilever beam 205 to help the second telescoping cantilever beam 205 better clear 480 obstacles 110 on the surface 105 for the user 60 to ambulate 115 along the surface 105, see FIGS. 2 through 4 and 14 through 16.

In FIG. 1, the substitute embodiment 56 of the structural brace apparatus is a slight alternation of the alternative embodiment 55 of the structural brace apparatus as previously described, wherein the first longitudinal axes 136 and 137 are parallel offset as are the second longitudinal axes 201 and 202 being also parallel offset similarly. Further, as shown in FIG. 1, the substitute embodiment 56 in comparison to the alternative embodiment 55 has reversed the first 900 and second 950 members in relation to the first 910 and second 960 primary pivotal members along the first longitudinal axes 136 and 137 for the purpose of easier adjustment of pivotal link connections 945 and 995 due to their closer proximity to the user hands 90. In addition, FIG. 1 shows that for the mechanism 265 included are substitute linkages 291 as between the first 125 and second 190 beam proximal end portions that create the symmetrical pivotal movement 270 without the need for the first 280 and second 285 finger extensions as shown in FIG. 7.

Wherein operationally, in looking at FIGS. 2 through 4 and 14 through 16, on the external structural brace apparatus 55 the user 60 is engaged 365 to the attachment element structure 335 at the user's 60 upper torso portion 65, further the user 60 utilizes each one of their hands 90 to manually grasp 725 each one of the third 755 and fourth 825 handle structures wherein the user 60 while standing with their hands 90 manually moves the first 120 and second 185 support extensions that are connected via the mechanism 265 in the primary pivotal movement 255 to place the first 140 and second 205 telescoping cantilever beams in contact with the surface 105 for user 60 stability in the single primary radial plane 260. At this point the user 60 is able to assume a seated position being supported on the surface 105 by the first 140 and 205 second telescoping cantilever beams, further the user 60 can ambulate 115 across the surface 105 via standing while simultaneously the user 60 pushing 800, 865 on the third 755 and fourth 825 handle structures toward the first 140 and second 205 telescoping cantilever beams that pushes downward 145, 210 on the first 140 and second 205 telescoping cantilever beams as the user's 60 arms 85 are extended to raise the entire external structural brace apparatus 55, thus assisting the user 60 to stand. At which point the user 60 pulls upward 805, 870 on the third 755 and fourth 825 handle structures resulting in the first 140 and second 205 telescoping cantilever beams lifting 750 from the surface 105 with the user 60 then momentarily balancing on their foot 95 on the surface 105. Subsequently, the user 60 utilizing the primary 255 and secondary 350 pivotal movements to selectively reposition the first 140 and second 205 telescoping cantilever beams on the surface 105 with the user 60 then pushing downward 600, 865 on the third 755 and fourth 825 handle structures to have the first 140 and second 205 telescoping cantilever beams contact 745 the surface 105 with the user 60 then repositioning their foot 95 on the surface 105 for balance.

Further, on the external structural brace apparatus 55, looking specifically at FIGS. 14 through 16, the third means 890 is preferably structurally constructed of a first pivotal engagement 760 including a first idle pivotal member 900 that has a first idle pivotal connection 905 with the third handle structure 755 and an opposing first idle pivotal connection 925 with a third arm 920 of the first proximal end portion 125. Further the first pivotal engagement 760 includes a first primary pivotal member 910 that has a first primary pivotal connection 915 with the third handle structure 755 and an opposing first primary pivotal connection 930 with a third arm 920 of the first proximal end portion 125. The third means 890 includes a first link 935 that is pivotally connected 940 to the first telescoping cantilever beam 140 and to the first primary pivotal member 945 positioned therebetween on the first primary pivotal member 910 between the third handle structure 755 first primary pivotal connection 915 and the third arm 920 first pivotal connection 930.

Wherein operationally when the third handle 755 is going from a retracted state 810, to a midpoint state 815, and to an extended state 820 the first telescoping cantilever beam 140 experiences a decreasing speed 775 of extension movement 145 from the first link 935 pivotal connection 945 to the first primary pivotal member 910, to allow for an easier surface 105 positional placement of the extended 155 first telescoping cantilever beam 140 by the user 60 for ambulation 115. Further, there is an increasing speed of retraction movement 780 of the first telescoping cantilever beam 140 as the third handle structure 755 is manually pulled away 805 from the first telescoping cantilever beam 140 in going from an extended state 155, to a midpoint state, to a retracted state 160, to help the first telescoping cantilever beam 140 better clear 480 obstacles 110 on the surface 105 for the user 60 to ambulate 115 along the surface 105, as shown in FIGS. 3, 4, and 14 through 16.

Further, on the external structural brace apparatus 55, looking specifically at FIGS. 14 through 16, the fourth means 895 is preferably structurally constructed of a second pivotal engagement 830 including a second idle pivotal member 950 that has a second pivotal connection 955 with the fourth handle structure 825 and an opposing second idle pivotal connection 975 with a fourth arm 970 of the second proximal end portion 190. Further the second pivotal engagement 830 includes a second primary pivotal member 960 that has a second primary pivotal connection 965 with the fourth handle structure 825 and an opposing second primary pivotal connection 980 with a fourth arm 970 of the second proximal end portion 190.

Also, the fourth means 895 includes a second link 985 that is pivotally connected 990 to the second telescoping cantilever beam 205 and to the second primary pivotal member 995 positioned therebetween on the second primary pivotal member 960 and between the fourth handle structure 825 second primary pivotal connection 965 and said fourth arm 970 pivotal connection 980.

Wherein operationally, when the fourth handle 825 is going from a retracted state 875, to a midpoint state 880, and to an extended state 885 the second telescoping cantilever beam 205 experiences a decreasing speed of extension movement 855 from the second link 985 pivotal connection 995 to the second primary pivotal member 960, to allow for an easier surface 105 positional placement of the extended 220 second telescoping cantilever beam 205 by the user 60 for ambulation 115, further there is an increasing speed of retraction movement 860 of the second telescoping cantilever beam 205 as the fourth handle structure 825 is manually pulled away 870 from the second telescoping cantilever beam 205 in going from an extended state 220, to a midpoint state, to a retracted state 225, to help the second telescoping cantilever beam 205 better clear 600 obstacles 110 on the surface 105 for the user 60 to ambulate 115 along the surface 105.

Due to the nature of FIGS. 14 through 16 showing primarily the "first" of a set of elements starting with the first idle pivotal member 900 and the fact that the external structural brace apparatus 55 utilizes a duplicate set of "second" elements starting with the second idle pivotal member 950, the second grouping is not necessarily shown in the Figures as it would be duplicative with no new matter disclosed, thus the "first" group of elements being 900, 905, 910, 915, 920, 925, 930, 935, 940, and 945 correspond to the "second" elements of 950, 955, 960, 965, 970, 975, 975, 980, 985, 990, and 995.

Due to the nature of FIGS. 14 through 16 showing primarily the "third" of a set of elements starting with the third handle structure 755 and the fact that the external structural brace apparatus 55 utilizes a duplicate set of "fourth" elements starting with the fourth handle structure 825, the fourth grouping is not necessarily shown in the Figures as it would be duplicative with no new matter disclosed, thus the "third" group of elements being, 755, 760, 765, 770, 775, 780, 785, 790, 795, 800, 805, 810, 815, 820, and 890 correspond to the "fourth" elements of 825, 830, 835, 840, 845, 850, 855, 860, 865, 870, 875, 880, 885, and 895.

Method of Use

Referring to FIGS. 2 through 4, 7 through 9, and 14 through 16, a method for using an external structural brace apparatus 55 is disclosed for supporting a user 60 on a surface 105 and for the user 60 to ambulate 115 along the surface 105 to relieve shoulder 75, armpit 80, hand 90, foot 95, and wrist 100 loads, the method comprising the steps of firstly providing an external structural brace apparatus 55 as previously disclosed in this specification. A second step of attaching 1000 the attachment element structure 335 to an upper torso portion 65 of the user 60 which can be derived from looking at FIGS. 2 through 4 and FIGS. 14 through 16 which embody the third 890 and fourth 895 means of extending 145 the first telescoping beam 140 and extending 210 the second telescoping beam 205, as FIGS. 2 through 4 show the attachment element structure 335 that utilizes the third 890 and fourth 895 means as shown in FIGS. 14 through 16. Thirdly a step of attaching 1005 the attachment structure 335 to a hip portion 70 of the user 60 for added user 60 stability in the external structural brace apparatus 55 as shown in FIGS. 2 through 4.

Fourth, a step of grasping manually 725, 1010 by hands 90 of the user 60 on each one of the third 755 and fourth 825 handle structures while the user 60 is standing 730, see FIGS. 2 through 4 and FIGS. 14 through 16. Fifth, a step of moving the user's 60 hands 90 manually in the primary pivotal movement 255 to move 735 the first 120 and second 185 support extensions that are connected via the mechanism 265 in the primary pivotal movement 255 to place the first 140 and second 205 telescoping cantilever beams in contact 745 with the surface 105 for user 60 stability in the single primary radial plane 260, at this point the user 60 is able to assume a seated position being supported on the surface 105 by said first 140 and second 205 telescoping cantilever beams. Sixth, a step of pushing 790, 845, the third 755 and fourth 825 handle structures toward the first 140 and second 205 telescoping cantilever beams with the user's 60 hands 90 on the third 755 and fourth 825 handle structures in going from the retracted state 810, 875, to the midpoint state 815, 880, and to the extended state 820, 885, that pushes downward on the first 140 and second telescoping 205 cantilever beams as the user's 60 arms 90 are extended to raise 1015 the entire external structural brace apparatus 55, thus assisting the user 60 to stand, see the combination of FIGS. 3, 4, and 14 through 16.

Seventh, a step of pulling 785, 840, the third 755 and fourth 825 handle structures away from the first 140 and second 205 telescoping cantilever beams via the user's 60 hands 90 on the third 755 and fourth 825 handle structures in going from the extended state 820, 885, to the midpoint state, 815, 880, and to the retracted state 810, 875, resulting in the first 140 and second 205 telescoping cantilever beams lifting away 1020 from the surface 105 with the user 60 then momentarily balancing on their foot 95 on the surface 105. Eighth, a step of initiating movement manually of the first 140 and second 205 support extension beams by the user 60 via grasping 725 the third 755 and fourth 825 handle structures for using the secondary pivotal movement 350 to selectively reposition in a direction of an ambulation 115 the first 140 and second 205 telescoping cantilever beams on the surface 105, as best shown in FIG. 2, plus combined with FIGS. 14 through 16.

Ninth, a step of pushing 790, 845 the third 755 and fourth 825 handle structures toward the first 140 and second 205 telescoping cantilever beams with the user's 60 hands 90 on the third 755 and fourth 825 handle structures in going from the retracted state 810, 875, to the midpoint state 815, 880, and to the extended state 820, 885 that pushes downward on the first 140 and second 205 telescoping cantilever beams as the user's 60 arms 90 are extended for the first 140 and second 205 telescoping cantilever beams to contact the surface 105. Tenth, a step of repositioning of the foot 95 of the user 60 on the surface 105 for balance.

Optionally a step of on the external structural brace apparatus 55 wherein the eighth initiating movement manually step further includes using the primary pivotal movement 255 of the first 120 and second 185 support extension beams combined with the secondary pivotal movement 350 manually 740, see FIG. 2 for clarity.

CONCLUSION

Accordingly, the present invention of an external structural brace apparatus 50 and 55 has been described with some degree of particularity directed to the embodiments of the present invention. It should be appreciated, though; that the present invention is defined by the following claims construed in light of the prior art so that modifications or changes may be made to the exemplary embodiments of the present invention without departing from the inventive concepts contained therein.

The invention claimed is:

1. A method for using an external structural brace apparatus for supporting a user on a surface and for the user to ambulate along the surface to relieve shoulder, armpit, hand, foot, and wrist loads, said method comprising the steps of: (a) providing an external structural brace apparatus that includes a first support extension beam having a first proximal end portion and an opposing first distal end portion and a first longitudinal axis spanning therebetween, said first distal end portion including a first telescoping cantilever beam having extension and retraction movement along said first longitudinal axis to vary a total length of said first support extension beam, wherein said first telescoping cantilever beam has intermittent contact with the surface, further a second support extension beam having a second proximal end portion and an opposing second distal end portion and a second longitudinal axis spanning therebetween, said second distal end portion including a second telescoping cantilever beam having extension and retraction movement along said second longitudinal axis to vary a total length of said second support extension beam, wherein said second telescoping cantilever beam has intermittent contact with the surface, wherein said first and second proximal end portions have a primary pivotal couple to one another, wherein said first and second support extension beams are limited to have a primary pivotal movement relative to one another in a single primary radial plane, further included is a mechanism affixed therebetween said first and second proximal end portions that causes said primary pivotal movement to be symmetrical as between said first and second distal end portions in equal and opposite directions, wherein a single primary pivotal movement initiated at said first distal end portion causes an automatic equal and opposite primary pivotal movement of said second distal end portion and a single primary pivotal movement initiated at said second distal end portion causes an automatic equal and opposite primary pivotal movement of said first distal end portion, also included is an attachment element structure that has a secondary pivotal connection to said first and second proximal end portions, allowing a secondary pivotal movement that is limited to a single secondary pivotal movement plane that is oriented in a perpendicular manner to said primary radial plane, wherein said attachment element structure is sized and configured to removably engage an upper torso portion of the user and said attachment element structure further comprises framework to removably engage a hip portion of the user to add stability and comfort for the user in sitting and standing with said attachment element through said secondary pivotal connection to said first and second support extension beams, in addition included is a third handle structure that has a first pivotal engagement on said first distal end portion, wherein said first pivotal engagement has movement along said first longitudinal axis, also a fourth handle structure that has a second pivotal engagement on said second distal end portion, wherein said second pivotal engagement has movement along said second longitudinal axis, further, a third means for facilitating same direction movement of said third handle structure and said first telescoping cantilever beam, wherein there is a decreasing speed of relative movement of said first telescoping cantilever beam in relation to said third handle structure movement, as said third handle structure is manually pushed toward said first telescoping cantilever beam, to accommodate the user being able to more precisely position said first telescoping cantilever beam on the surface as the user's arm is extended toward said first telescoping cantilever beam, further there is an increasing speed of retraction movement of said first telescoping cantilever beam as said third handle structure is manually pulled away from said first telescoping cantilever beam to help said first telescoping cantilever beam better clear obstacles on the surface for the user to ambulate along the surface, when said third handle structure is manually pushed toward said first telescoping cantilever beam, said third handle is going from a retracted state, to a midpoint state, and to an extended state, and when said third handle structure is manually pulled away from said first telescoping cantilever beam, said third handle is going from the extended state, to the midpoint state, and to the retracted state, also included is a fourth means for facilitating same direction movement of said fourth handle structure and said second telescoping cantilever beam, wherein there is a decreasing speed of relative movement of said second telescoping cantilever beam in relation to said fourth handle structure movement, as said fourth handle structure is manually pushed toward said second telescoping cantilever beam, to accommodate the user being able to more precisely position said second telescoping cantilever beam on the surface as the user's arm is extended toward said second telescoping cantilever beam, further there is an increasing speed of retraction movement of said second telescoping cantilever beam as said fourth handle structure is manually pulled away from said second telescoping cantilever beam to help said second telescoping cantilever beam better clear obstacles on the surface for the user to ambulate along the surface, when said fourth handle structure is manually pushed toward said second telescoping cantilever beam, said fourth handle is going from a retracted state, to a midpoint state, and to an extended state, and when said fourth handle structure is manually pulled away from said second telescoping cantilever beam, said fourth handle is going from the extended state, to the midpoint state, and to the retracted state, wherein operationally the user is engaged to said attachment element structure at the user's upper torso portion and hips, further the user utilizes each one of their hands to manually grasp each one of said third and fourth handle structures wherein the user while standing with their hands manually moves said first and second support extensions that are connected via said mechanism in said primary pivotal movement to place said first and second telescoping cantilever beams in contact with the surface for user stability in said single primary radial plane, at this point the user is able to assume a seated position being supported on the surface by said first and second telescoping cantilever beams, further the user can ambulate across the surface via standing while simultaneously the user pushing said third and fourth handle structures toward said first and second telescoping cantilever beams that pushes downward said first and second telescoping cantilever beams as the user's arms are extended to raise said entire external structural brace apparatus, thus assisting the user to stand, at which point the user pulls upward on said third and fourth handle structures away from said first and second telescoping cantilever beams resulting in said first and second telescoping cantilever beams lifting from the surface with the user then momentarily balancing on their foot on the surface, and subsequently the user utilizing said primary and secondary pivotal movements to selectively reposition said first and second telescoping cantilever beams on the surface with the user then pushing said third and fourth handle structures toward said first and second telescoping cantilever beams to have said first and second telescoping cantilever beams contact the surface with the user then repositioning their foot on the surface for balance. (b) attaching said attachment element structure to the upper torso portion of the user; (c) attaching said attachment structure to the hip portion of the user; (d) grasping manually by hands of the user each one of said third and fourth handle structures while the user is standing; (e) moving the user's hands manually in said primary pivotal movement to move said first and second support extensions that are connected via said mechanism in said primary pivotal movement to place said first and second telescoping cantilever beams in contact with the surface for user stability in said single primary radial plane, at this point the user is able to assume a seated position being supported on the surface by said first and second telescoping cantilever beams; (f) pushing said third and fourth handle structures toward said first and second telescoping cantilever beams with the user's hands on said third and fourth handle structures in going from said retracted state, to said midpoint state, and to said extended state that pushes downward on said first and second telescoping cantilever beams as the user's arms are extended to raise said entire external structural brace apparatus, thus assisting the user to stand; (g) pulling said third and fourth handle structures away from said first and second telescoping cantilever beams via the user's hands on said third and fourth handle structures in going from said extended state, to said midpoint state, and to said retracted state resulting in said first and second telescoping cantilever beams lifting away from the surface with the user then momentarily balancing on their foot on the surface; (h) initiating movement manually of said first and second support extension beams by the user via grasping said third and fourth handle structures for using said secondary pivotal movement to selectively reposition in a direction of an ambulation said first and second telescoping cantilever beams on the surface; (i) pushing said third and fourth handle structures toward said first and second telescoping cantilever beams with the user's hands on said third and fourth handle structures in going from said retracted state, to said midpoint state, and to said extended state that pushes downward on said first and second telescoping cantilever beams as the user's arms are extended for said first and second telescoping cantilever beams to contact the surface; and (j) repositioning of the foot of the user on the surface for balance.

2. A method for using an external structural brace apparatus according to claim 1 wherein said initiating movement manually step further includes using said primary pivotal movement of said first and second support extension beams combined with said secondary pivotal movement.

* * * * *